US011982181B2

(12) United States Patent
Weber et al.

(10) Patent No.: US 11,982,181 B2
(45) Date of Patent: May 14, 2024

(54) PULSER CYCLE SWEEP METHOD AND DEVICE

(71) Applicant: RIME Downhole Technologies, LLC, Benbrook, TX (US)

(72) Inventors: Robert A Weber, Fort Worth, TX (US); Manoj Gopalan, Fort Worth, TX (US)

(73) Assignee: RIME Downhole Technologies, LLC, Benbrook, TX (US)

( * ) Notice: Subject to any disclaimer, the term of this patent is extended or adjusted under 35 U.S.C. 154(b) by 31 days.

(21) Appl. No.: 17/555,446

(22) Filed: Dec. 18, 2021

(65) Prior Publication Data

US 2023/0160303 A1 May 25, 2023

Related U.S. Application Data

(60) Provisional application No. 63/264,347, filed on Nov. 19, 2021.

(51) Int. Cl.

| | |
|---|---|
| ***E21B 47/18*** | (2012.01) |
| ***E21B 47/20*** | (2012.01) |
| ***E21B 47/24*** | (2012.01) |

(52) U.S. Cl.

CPC ..... *E21B 47/20* (2020.05); *E21B 47/18* (2013.01); *E21B 47/24* (2020.05)

(58) Field of Classification Search

CPC ..... E21B 47/20; E21B 47/24; E21B 47/18; E21B 7/046

See application file for complete search history.

(56) References Cited

U.S. PATENT DOCUMENTS 4,785,300 A * 11/1988 Chin ..... E21B 47/18 137/499
4,953,595 A * 9/1990 Kotlyar ..... E21B 21/10 137/624.13

(Continued)

FOREIGN PATENT DOCUMENTS

EP 0617196 A2 9/1994
WO 2017079829 A1 5/2017

OTHER PUBLICATIONS

RIME Downhole Technologies, LLC; PCT/US2022/080129 (filed Nov. 18, 2022); Written Opinion of the International Search Authority (PCT/ISA/237), 6 pp.

(Continued)

*Primary Examiner* — Jennifer H Gay
(74) *Attorney, Agent, or Firm* — Timothy G. Ackermann

(57) ABSTRACT

A servo valve in a servo pulser used to restrict flow to a larger main valve includes external stops on a housing to define rotational starting/stopping points and sweep zones for a servo rotor having digits for contacting the stops. The digits extend longitudinally away from the servo valve seat and extend into the sweep zones. Interaction between the stops and the digits in the sweep zones limit rotation of the rotor to a swept arc between the stops. The servo pulser rotor oscillates between stopping points in alternating clockwise/counterclockwise sweeps. Each sweep in a given direction creates one full pulse: closed, open, and closed. The servo pulser carries out a feedback/decision loop between hydraulic pulses (and sweeps) that receives information on one or more previous pulses and calculates how fast or slow it should drive the servo rotor for the current pulse.

48 Claims, 15 Drawing Sheets

(56) References Cited

U.S. PATENT DOCUMENTS

| | | | | |
|---|---|---|---|---|
| 5,010,917 | A * | 4/1991 | Iqbal | F16K 27/045 137/454.6 |
| 6,016,288 | A * | 1/2000 | Frith | E21B 47/24 181/102 |
| 6,714,138 | B1 * | 3/2004 | Turner | E21B 47/20 340/856.4 |
| 6,970,398 | B2 * | 11/2005 | Lavrut | G01V 1/137 415/55.2 |
| 8,666,908 | B2 * | 3/2014 | Hall | G06Q 30/04 705/400 |
| 9,133,950 | B2 * | 9/2015 | Gopalan | E21B 47/20 |
| 9,316,072 | B2 * | 4/2016 | Rogers | F16K 3/085 |
| 9,528,371 | B2 * | 12/2016 | Liu | E21B 47/18 |
| 10,301,879 | B2 * | 5/2019 | Hay | E21B 28/00 |
| 10,392,931 | B2 * | 8/2019 | Gopalan | E21B 34/16 |
| 10,465,506 | B2 | 11/2019 | Barbely | |
| 10,689,976 | B2 * | 6/2020 | Gopalan | E21B 34/16 |
| 11,319,764 | B2 * | 5/2022 | Messa | E21B 28/00 |
| 2006/0034154 | A1 | 2/2006 | Perry et al. | |
| 2006/0283632 | A1 * | 12/2006 | Hall | E21B 47/022 175/45 |
| 2007/0182583 | A1 * | 8/2007 | Feluch | E21B 47/24 340/855.4 |
| 2010/0008188 | A1 * | 1/2010 | Hall | G06Q 30/04 705/400 |
| 2012/0273271 | A1 * | 11/2012 | Stuart-Bruges | E21B 47/24 340/853.3 |
| 2013/0277119 | A1 * | 10/2013 | Rogers | E21B 47/18 175/317 |
| 2014/0102793 | A1 * | 4/2014 | Hall | E21B 47/022 175/40 |
| 2014/0124693 | A1 * | 5/2014 | Gopalan | F16K 27/045 251/359 |
| 2016/0010449 | A1 * | 1/2016 | Liu | F15B 21/125 166/66.4 |
| 2016/0258287 | A1 * | 9/2016 | Kolle | E21B 47/24 |
| 2016/0305188 | A1 * | 10/2016 | Hay | E21B 21/10 |
| 2018/0128099 | A1 * | 5/2018 | Barbely | E21B 47/12 |
| 2018/0179841 | A1 * | 6/2018 | Messa | E21B 34/14 |
| 2019/0211673 | A1 * | 7/2019 | Gopalan | E21B 34/16 |
| 2019/0368343 | A1 * | 12/2019 | Gopalan | E21B 47/24 |
| 2019/0383138 | A1 * | 12/2019 | Odegbami | E21B 34/06 |
| 2021/0277743 | A1 * | 9/2021 | Schultz | E21B 43/121 |
| 2021/0372278 | A1 * | 12/2021 | Sauthoff | E21B 34/06 |
| 2022/0341316 | A1 * | 10/2022 | Sun | E21B 47/12 |
| 2022/0389812 | A1 * | 12/2022 | Richards | E21B 47/24 |

OTHER PUBLICATIONS

RIME Downhole Technologies, LLC; PCT/US2022/080129 (filed Nov. 18, 2022); International Search Report of the International Search Authority (PCT/ISA/220), 5 pp.

* cited by examiner

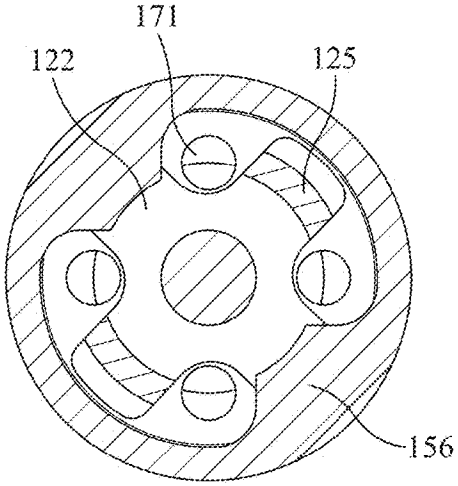
FIG. 7F
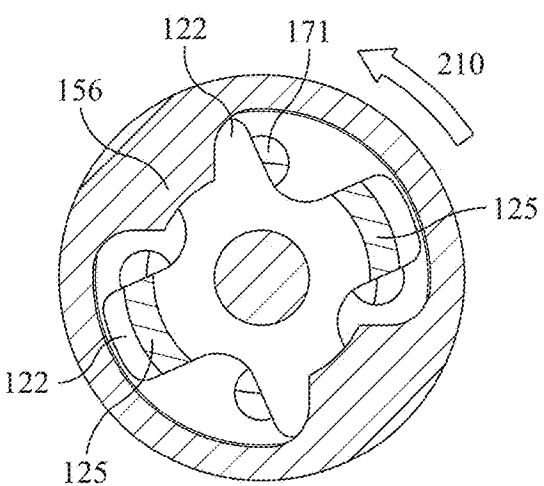
FIG. 7G
FIG. 7H
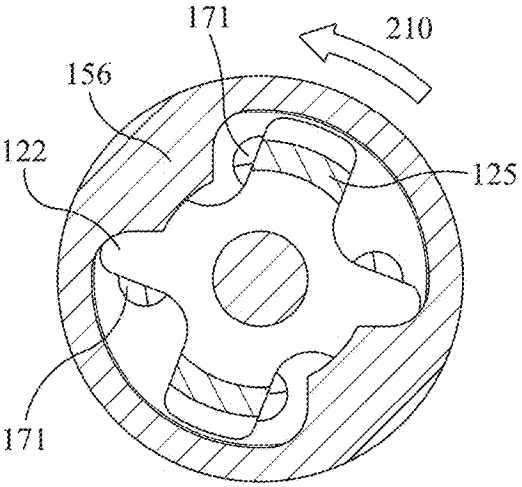
FIG. 7I
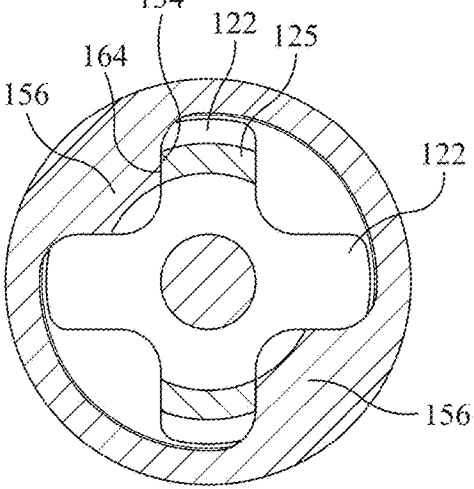
FIG. 7J

PULSER CYCLE SWEEP METHOD AND DEVICE

REFERENCE TO RELATED APPLICATIONS

This application incorporates U.S. Pat. Nos. 9,133,950 B2, 10,392,931 B2, and 10,689,976 B2, in their entirety. This application claims priority to U.S. Provisional Patent Appl. No. 63/264,347.

FIELD OF THE INVENTION

In general, the present invention relates to a device, system or method including a hydraulically assisted pulser system, including a main pulser and a servo pulser that includes a rotary servo valve for actuating the pulser, for generating pressure pulses in a fluid column during the process of drilling a subterranean borehole with the intent of using said pressure pulses to encode information and telemeter such information to the surface in real time. In operation, the assembled apparatus or "Measurement While Drilling (MWD) tool" includes a servo pulser coupled to a main pulser, a controller, a sensor package, and a battery power source, all of which reside inside a short section of drill pipe close to the bit at the bottom of the borehole being drilled.

Specifically, in MWD systems, sensor data from many sensors including accelerometers, magnetometers, and gamma ray detectors are encoded. Using a pulser, this encoded information can be telemetered to the surface. The pulser works by directly or indirectly restricting flow from the mud pumps at the surface which causes a small increase in pressure. These pressure pulses are used to encode and transmit the sensor data, and the data is telemetered to the surface using a sequence of pressure pulses. A surface system will read this change in surface pressure caused by these pressure pulses using a pressure transducer at the surface location and decode the encoded data thus telemetered. Battery systems are provided to power all or most of the electronic components.

The invention described in this document details a novel and improved invention for the generation of said pressure pulses in a servo pulser that uses a rotary servo valve.

BACKGROUND OF THE INVENTION

Servo pulser mechanisms are used to open and close small valves which in turn create pressure differences in specific portions of the MWD tool when said MWD tool is exposed to the flow of drilling fluid during the routine course of drilling a borehole. These differences in pressure in portions of the MWD tool are then used to actuate a main valve which in turn causes much bigger pressure changes in the fluid flow during the drilling operation. As servo pulser mechanisms open and close smaller valves which in turn actuate larger valves, the servo pulsers port fluid in such a way as to allow the drilling mud (fluid) flow itself to do most of the work of opening and closing the main pulser valve to generate pulses that are used to transmit data. Such a servo mechanism assisted pulser may also be called a hydraulically assisted pulser. A servo pulser and main pulser may be so configured that the following relationship exists: when the servo valve is closed, the main valve is thus open; the servo valve opens and the main valve thus closes, generating a pressure increase; and the servo valve closes and the main valve thus opens generating a pressure decrease, the combination of the two actions resulting in a complete pressure pulse.

A servo pulser may use a pilot valve to restrict or selectively port fluid flow to a larger main valve (main pulser). A servo valve may include a valve seat and a rotating portion driven by a servo shaft. The rotating part includes structures to obstruct flow through the valve seat. The structures may extend axially off the rotating part to contact the valve seat. Those structures may be longitudinally-extending and/or protruding tips formed to slide rotatably over the valve seat. The rotating part may include a rotor having radially-extending arms for the tips. The arms may include one or no digits (or arm-stops) extending axially in a direction away from the tips. More than one fluid path may be provided through the servo pulser, such as by four holes in the valve seat, which may be circular, and may be symmetrical about the axis around which the rotating part rotates The rotation of the rotating part may be limited by one or more stops. The stops are rotationally fixed with respect to the fluid path, or in one embodiment, the valve seat, and are indirectly in contact with that seat. These may be mechanical stops built into the servo pulser. These mechanical stops may thus be located partially inboard of the outer diameter of the servo valve seat and in a fixed rotational orientation to that servo valve seat. Such mechanical stops provide a rotational position that is fixed with respect to the servo valve seat.

A servo pulser includes a servo screen housing onto which are mounted a plurality of screens. The screens allow drilling fluid to enter the valve portion of the servo pulser while at the same time restricting the ingress of large particulate matter as are sometimes present in the drilling fluid. The servo screen housing also houses a servo seat (a valve seat). The servo screen housing includes radially-inwardly extended keys, extending from an inner surface of the servo screen housing, to align the servo seat to the servo screen housing and restrict the ability of the servo seat to rotate relative to the servo screen housing or to translate axially toward the rotor. The mechanical stops built into the servo pulser may be formed on an interior surface of the servo screen housing by extending portions of that housing radially-inwardly along portions of the circumferential extent of the housing.

The servo valve seat and flow obstructing structures may be hard and/or wear- and abrasion-resistant. The servo shaft, stops, supporting structure, and rotating part may be non-brittle, and shock and vibration resistant.

The rate at which discrete pressure pulses are created affects the data rate of the overall MWD tool. Each servo pulser pulse causes the main pulser to transmit a single pulse which can encode and transmit a finite number of data bits to the surface. Thus, increasing the servo pulser's pulse rate, and so the main pulser's pulse rate, can increase the overall data rate. Another factor is the width of the pulse (correlating to its length in time). In many MWD systems, the pulses used have a desired constant width, however varying widths of pulses can be used to encode and transmit additional bits.

A rotary servo pulser relies upon electrical power provided by the battery unit in the MWD tool. Electrical power is required for the servo pulser, including electronics and controls in the servo pulser. The primary battery drain caused by the servo pulser is powering the motor that drives the rotation of the pilot valve. That motor must accelerate and decelerate (brake) the mass of the rotating portion of the pilot valve against the drilling fluid in the servo pulser, where braking may be achieved by shorting the windings together to ground. In addition, accelerating the rotor to begin rotation from a stopped state causes a current spike on the battery line, the said current spike consuming a significant portion of the energy required to generate a pulse.

As such, designing a servo pulser that can open and close to actuate the main valve efficiently, either by reducing the number of servo pilot movements required per pulse, thereby reducing the number of current spikes and thus the energy required per pulse, or by reducing the time required to open and close the servo valve, or by any other method to reduce energy consumption and relatedly increase hydraulic performance of the servo valve, is advantageous.

BRIEF STATEMENT OF THE INVENTION

The current invention described below is for a novel rotary servo pilot valve and associated methods for operating said servo valve which provides many improvements over existing prior art. Although many embodiments are possible, specific embodiments are described in described in brief below.

In an embodiment, a servo pulser uses a pilot valve/servo valve to restrict flow to a larger main/pulser valve. The pilot valve interacts with/includes external stops for defining two rotational starting/stopping points and at least one sweep zone for a rotor having four laterally-extending arms, the rotor being driven by a servo shaft, and the shaft being driven directly or indirectly by an electric motor. The stops are formed on an interior surface of the servo screen housing and extend inwardly for only some portions of the circumferential extent of the housing and define the one or more sweep zones of around 90 degrees or exactly 90 degrees. The sweep zones define the about or exactly 90-degree sweep arc in which the rotor is permitted to move between the starting/stopping points. Four protruding servo tips extend longitudinally toward the seat, one from each arm of the rotor, for contacting the valve seat and closing the servo holes. Two digits extend longitudinally away the seat, one each from two opposite arms of the rotor, for contacting the stops. Each digit extends into a sweep zone formed in a rotor section of the servo screen housing by the stops, where the interaction between the stops and the digit in the sweep zone limits rotation of the rotor to the swept arc between the stops. The valve seat includes four axial servo holes therein for fluid flow that can be selectively interrupted by the servo tips obstructing flow through the servo holes to create pressure changes. The valve seat also includes four travel zones, through which there is no fluid flow, between the servo holes. The travel zones are locations that the servo tips can be positioned, or could be traveling through, in which the tips do not obstruct the servo holes. In an embodiment, these travel zones are about 20-25 degrees, or about 22 degrees, in extent, and are centered at about midway through the 90-degree sweep arc (thus at about 34 to 56 degrees from a given endpoint).

A pulse, or pressure pulse, is experienced in the mud (drilling fluid) in communication with the main pulser. A pulse includes: (i) a low-pressure state in the drilling fluid at the pulser main valve (0-signal), which is a substantially stable low pressure, associated with the servo tips obstructing the servo holes and with being at a stopping point; (ii) a pressure increase state or transition in the drilling fluid flow at the pulser main valve, associated with the servo tips progressively opening up the servo holes as they rotate with the rotor; (iii) a high-pressure state in the drilling fluid at the pulser main valve (1-signal), which is a substantially stable and increased pressure, associated with the servo tips having fully opened up the servo holes; (iv) a pressure drop state or transition in the drilling fluid at the pulser main valve, associated with the servo tips progressively closing off the servo holes as they rotate with the rotor; and (v) a return to the low-pressure state in the drilling fluid at the pulser main valve (0-signal), associated with the servo tips obstructing the servo holes and with being at a stopping point.

One embodiment includes a number ("x") of servo holes, of radially-extending arms on a rotor, and of servo tips, and fewer than x of axially-extending digits and of sweep zones. In an embodiment, the servo holes are even distributed circumferentially about, and on a plane normal to, the rotor's axis of rotation. An embodiment with x servo holes has a desired sweep arc s of at or about 360/x degrees, to permit the servo tips to be aligned to the servo holes at the end points of the sweep. In an embodiment in which x>2, sweep arc s may be a multiple of 360/x, where the multiple is <x. E.g. if x=3, s could be 120 degrees or 240 degrees; if the latter, then a sweep would cause a given servo tip start at one servo hole, sweep between it and the next, reach and close the next servo hole, sweep off that hole opening it, and sweep between it and the third hole, and then reach and close the third servo hole, thus causing multiple pulses per sweep.

One embodiment includes an equal and even number ("n") of servo holes, or radially-extending arms, and or servo tips, and up to n/2 of axially-extending digits and n/2 of sweep zones. An embodiment with n/2 axially-extending digits and sweep zones permits assembly of the shaft assembly (including the rotor, arms, tips, and digits) with the valve seat, valve seat retainer, and rotor section (with the stops) in up to n/2 radial orientations where each is functional because each digit will hit one of the stops at the end of a desired sweep arc s of at or about 360/n degrees. Additionally, this arrangement permits the digits to be mechanically balanced as they are radially-opposing and further permits distributing stopping forces (i.e. digits impacting the stops) across more than one digit/arm.

In an embodiment, each of the stopping points is caused by mechanical interaction of stops on the screen housing and axially-extending digits on arms of the rotor. The axially-extending digits are on a first arm of the rotor and on a second arm of the rotor separated from the first arm by an arm lacking a digit. In an embodiment, a first (or clockwise "CW") stopping point is caused by mechanical interaction of the axially-extending digits and first, CW, stops on the screen housing at the CW end of the sweep zones. A second (or counterclockwise "CCW") stopping point is caused by mechanical interaction between the digits and second, CCW, stops on the screen housing at the CCW end of the sweep zones.

In an embodiment, there is just one digit, and each of the stopping points is caused by mechanical interaction of a stop on the screen housing and one axially-extending digit on one arm of the rotor. In an embodiment, a first (or clockwise "CW") stopping point is caused by mechanical interaction of a first, CW, stop on the screen housing and the axially-extending digit on one arm of the rotor, and a second (or counterclockwise "CCW") stopping point is caused by mechanical interaction of a CCW stop on the screen housing and the digit. In an embodiment, only one sweep zone is provided, to prevent improper orientation/rotation of the rotor.

Variants could exist of an odd number of holes and buttons, but it would be necessary during assembly to ensure that the digit(s) were located in the correct sweep zone.

In an embodiment, the servo pulser oscillates between the stopping points in alternating clockwise/counterclockwise sweeps. Each sweep in a given direction creates one full pulse. Each sweep starts with the servo pulser in a closed status, with four servo tips at rest and fully obstructing four servo holes, then passes through the servo pulser being in an open state, with the four servo tips at rest or in motion, and not obstructing the four servo holes, and then ends with the servo pulser in a closed status, with the four servo tips at rest and fully obstructing the four servo holes. Each sweep is a 90-degree arc.

The period of time from the beginning of rotation of the servo valve to the end of rotation of the servo valve may be referred to as the pulse width. In an embodiment, pulse width may be at or about 1 s, at or about 0.5 s, at or about 0.25 s, or at or about 0.1 s.

The number of servo tips, servo holes, travel zones, and servo holes here is four, though the number could vary depending upon needs and the size of the servo pulser in use, and the shape/size of the holes and configuration of the internal fluid flow paths. Embodiments where the holes are not placed in an angularly symmetric pattern are possible, and the resultant shape of the hole pattern and the associated rotor with the servo tips could be envisioned to be in the shape of the letter 'X' or the letter 'Y'. In such embodiments, the angle between pairs of holes and their associated stops on the servo housing can be derived using the relationship between the bolt diameter of the holes and the diameter of the servo seat, and their relationship to the diameter of the servo tips, and subsequently the angle of rotation required to first open the servo holes, the angle required to position the servo tip in the sweep zone and the angle required to further close the servo holes.

In an embodiment, the servo pulser oscillates between the stopping points in alternating clockwise/counterclockwise sweeps. Each sweep in a given direction creates one full pulse. Each sweep starts with the rotor at one of the stopping points, with the drilling fluid at a low pressure indicating a 0-signal, then the drilling fluid passing through the pressure increase, then reaching a high pressure indicating a 1-signal, remaining at a pressure indicating a 1-signal for a finite period of time, then the drilling fluid passing through the pressure drop, then the drilling fluid returning to a low pressure indicating a 0-signal.

In an embodiment, the servo pulser oscillates between the stopping points in alternating clockwise/counterclockwise sweeps. Each sweep in a given direction creates one full pulse, in a 0-signal-1-signal-0-signal progression (or 0-1-0 progression), rather than each sweep in a given direction creating an initial half-pulse (a 0-signal-1-signal progression or 0-1 progression) followed by a return sweep in the opposite direction to complete the pulse (a 1-signal-0-signal progression or 1-0 progression).

In an embodiment, the servo pulser creates a full pulse, beginning at the CCW stop and rotating in a clockwise direction in 0-1-0 progression and ending at the CW stop. Then the servo pulser creates another full pulse, beginning at the CW stop and rotating in a counterclockwise direction in 0-1-0 progression and ending at the CCW stop.

In an embodiment, the servo pulser oscillates clockwise and then counterclockwise to create two consecutive pulses, in 0-1-0-1-0 progression, beginning at the CCW stop and rotating in a clockwise direction to the CW stop, then rotating in a counterclockwise direction from the CW stop to the CCW stop.

In an embodiment, the servo pulser oscillates between the stopping points in alternating clockwise/counterclockwise sweeps with an intermediate stop between the stopping points in the open state. Each sweep in a given direction creates one full pulse. Each sweep starts with the motor driving the shaft, accelerating the rotor of the servo pulser from a closed state, with the four servo tips at rest and fully obstructing the four servo holes, through the transition, and toward the servo pulser being in an open state. Then, after an optional period of coasting (no applied acceleration or deceleration) the motor then decelerates the rotor so that it stops with the servo pulser in that open state, with the four servo tips not obstructing the four servo holes (and may begin decelerating before or after reaching such state). The period of time for which the servo tips are at rest and not obstructing the servo holes is the dwell time, and the stop (and the dwell time) enlarges the pulse width. Then the motor accelerates the rotor from the open state (in the same direction as the previous acceleration), through the transition, toward the servo pulser being in a closed state. Then, after an optional period of coasting, motor decelerates the rotor so that it stops with the servo pulser in that closed state, with the four servo tips at rest and fully obstructing the four servo holes (and may begin decelerating before reaching such state). Each sweep is a 90-degree arc and each such arc includes two acceleration events and deceleration events. The dwell time lies exists between the first deceleration events and the second acceleration events, and the coasting time(s) exist, optionally, between acceleration and then deceleration events.

In an embodiment, the servo pulser oscillates between the stopping points in alternating clockwise/counterclockwise sweeps without any intermediate stop between the stopping points in the open state (i.e. dwell time is equal to 0). Each sweep in a given direction creates one full pulse. Each sweep starts with the motor driving the shaft, accelerating the rotor of the servo pulser from a closed state, with the four servo tips at rest and fully obstructing the four servo holes, through the transition, and toward the servo pulser being in an open state. Then, after an optional period of coasting (no applied acceleration or deceleration), the motor then optionally decelerates the rotor to extend the time for which the servo pulser is in that open state, with the four servo tips not obstructing the four servo holes. During this coasting period, the rotor does not cease its rotation at any point in time, resulting in a dwell time of zero (0) seconds. Then the motor optionally accelerates the rotor (in the same direction as the previous acceleration), through the transition, toward the servo pulser being in a closed state. Then, after an optional period of coasting, motor decelerates the rotor so that it stops with the servo pulser in that closed state, with the four servo tips at rest and fully obstructing the four servo holes (and may begin decelerating before reaching such state). Each sweep is a 90-degree arc and each such arc includes at least one acceleration event and at least one deceleration events and may include two of each. The coasting time(s) exist, optionally, between the acceleration and then deceleration events, and between the deceleration and acceleration events.

In an embodiment, the servo pulser oscillates between the stopping points in alternating clockwise/counterclockwise sweeps without any intermediate stop or coast between the stopping points in the open state (i.e. dwell time is equal to 0). Each sweep in a given direction creates one full pulse. Each sweep starts with the motor driving the shaft, accelerating the rotor of the servo pulser from a closed state, with the four servo tips at rest and fully obstructing the four servo holes, through the transition, and toward the servo pulser being in an open state. The motor continues to drive the servo tips in the same direction continuously without coasting or decelerating the rotor, and thus rotates continuously. Then, the motor decelerates the rotor so that it stops with the servo pulser in that closed state, with the four servo tips at rest and fully obstructing the four servo holes (and may begin decelerating before reaching such state). Each sweep is a 90-degree arc and each such arc includes at least one acceleration event and at least one deceleration events and may include two of each. In this embodiment, the servo tips make the fastest possible transition from the 0 state, through the 1 state and back to the 0 state, thus resulting in the smallest possible pulse width.

It will be obvious to anyone versed in the art that the rotational speed of the motor, and thus the rotor and attached servo tips, could be adjusted by many means, including methods such as changing the voltage applied to the motor thus increasing or decreasing its speed or by pulse width modulating the voltage applied to the motor to achieve a slower rotation speed. Embodiments where such methods are used to achieve desired results are clearly possible, including adjusting the speed of the rotor during the acceleration or deceleration phases to either increase or reduce said acceleration or deceleration times. In addition, in certain embodiments, the motor speed adjusted using one or more of the above methods to entirely eliminate the need for coasting or stopping (dwell) during the generation of single pulse. Conversely, in certain embodiments, the coasting time or the dwell time are increased to achieve wider pulse widths. For example, in an embodiment, the motor speed is set to a high or maximum-achievable value to accelerate the rotor and the attached servo tips to a high rotational speed until the servo tips no longer obstruct the servo holes, and then the speed of the motor (and the attached rotor and servo tips) is reduced so as to rotate at a lower rotational speed through the sweep zone, and then the rotational speed of the motor is increased past the sweep zone to continue rotation in the direction to further close the servo holes (with or without coasting near the end of the 0-1-0 pulse cycle); all done in such a way so as to achieve a desired pulse width without stopping the rotation of the servo valve, or without coasting the servo valve.

In other embodiments, there are an equal and odd number ("m") of servo holes, radially-extending arms, and servo tips, and up to (m−1)/2 axially-extending digits and up to (m−1)/2 sweep zones. An embodiment with (m−1)/2 axially-extending digits permits assembly of the shaft assembly (including the rotor, arms, tips, and digits) with the valve seat, screen housing, and rotor section (with the stops) in up to (m−1)/2 radial orientations where each is functional because each digit will hit one of the stops at the end of a desired sweep arc s of about 360/m degrees.

In one embodiment, the pilot valve includes external stops for defining two rotational starting/stopping points for a rotor having three laterally-extending arms and one servo tip on each arm, and three servo holes on the servo seat. The valve seat also includes three travel zones, through which there is no fluid flow, as locations that the servo tips can be positioned, or could be traveling, in which the tips do not obstruct the servo holes. The servo pulser oscillates between the stopping points in alternating clockwise/counterclockwise sweeps. Each sweep in a given direction creates one full pulse. Each sweep starts with the servo pulser in a closed status, with the three servo tips at rest and fully obstructing the three servo holes, passes through the servo pulser being in an open state, with the three servo tips at rest or in motion, and not obstructing the three servo holes, and ends with the servo pulser in a closed status, with the three servo tips at rest and fully obstructing the three servo holes. Each sweep is a 120-degree arc.

In an embodiment, the servo pulser's pulse rate is the same as its sweep rate. That is, the servo pulser creates one full pulse, low-high-low (0-1-0 progression) in one sweep. In this embodiment, the pulser's sweep time (the time for one sweep) also correlates to the time period required to complete one pulse (not the pulse width). This is in contrast to the situation in which a servo pulser's pulse rate is half of its sweep rate, such as if it required a first sweep to create the low pressure and a second sweep to return to the high pressure.

The time to accomplish any sweep is a function of, among other things, the arc length of the sweep, any stops or coasting during the sweep, and the acceleration (in either direction) applied to the mass of the rotating portion of the pilot valve, including acceleration to an increased rotational velocity (such as from rest) and acceleration (deceleration) to a reduced rotational velocity (such as to rest). The acceleration applied is a function of, among other things, the mass of the rotating portion of the pilot valve, the density of the drilling fluid, and the applied motive power. The first is invariant on a given configuration of the MWD tool, and the second is driven by other factors. Thus, controlling how much power is applied to the motor is used to control acceleration and, indirectly, sweep time. Naturally, shorter sweep times, for a given rotation, require higher (or longer) acceleration and more power, as do starting/stopping during a sweep. And sweep time is also a function of the time required for the rotating portion of the pilot valve to accelerate from rest to a desired rotational speed.

In an embodiment, the servo pulser increases the servo pulser's pulse rate by reducing the time to create one pulse at a particular power requirement (or it could reduce the power required for creating one pulse at a given time). Because one sweep creates one full pulse (in 0-1-0 progression), no change of direction is required for that one pulse. That is rather than the servo pulser having to reverse its direction of rotational travel between a first sweep and a return sweep to create a full pulse. Each change of direction, naturally, requires fully decelerating and the re-accelerating the mass of the rotating portion of the pilot valve. This takes time for the rotating portion to reach a desired speed as its speed comes up from zero. Thus, even though a given sweep arc may be greater, the rotating portion can spend a greater time at a desired speed as it does not return to rest in mid-pulse, meaning the overall sweep speed can be higher, and the sweep time lower. In an embodiment, the servo pulser reduces the servo pulser's power consumption reducing the amount of acceleration applied to the rotating portion of the pilot valve, and thus the power used by the motors to do so. Because one sweep creates one full pulse (in 0-1-0 progression), no change of direction is required for that one pulse.

In an embodiment, when a servo pulser is turned on, an algorithm is used to move the pilot valve to (or confirm its presence at) one of the two stopping points, with CW being the default, thus ensuring that the servo pulser is positioned in the 0 state prior to any operation. Thus, it is set at a fixed location which the servo pulser's microcontroller can use as an initial condition in commanding further rotation.

In an embodiment, the servo pulser's microcontroller receives and/or calculates the time required to move the rotating portion of the valve, and retains that time for use in further computations or actuations. This includes retaining the time for previous sweeps. Likewise, the microcontroller retains such information as the intended velocity/acceleration profile, the time required to accelerate or decelerate, the time spent in the sweep zone under various conditions such as coasting, etc, and receives and retains information about the applied current or applied power from previous sweeps.

Frequently, each pulse has the same desired constant width and the microcontroller can assume that the previous pulse's width (which was retained) is the same as the next one. In an embodiment, the microcontroller applies feedback to calculate the intended velocity/acceleration, coasting or dwell profile and current and/or power usage for the next sweep, by using the previous sweep's (or sweeps') data for those items to adjust the current sweep's applied current/power (or velocity/acceleration, coasting or dwell profile) to attempt to cause the current sweep's pulse width, power, current, energy consumed, sweep time, dwell time, stop time or any other parameter to conform to the desired value.

In an embodiment, the system calculates the amount of dwell time or braking without dwell time is needed to achieve the desired pulse width. A calculated solution might be if the desired pulse width is smaller than can be achieved by applying maximum acceleration (and deceleration) to the rotor; or in other words, the rotor cannot open and close fast enough to generate the desired pulse width. Other situations could be when the pulse width desired is longer than the minimum calculated time to open and close the servo valve. Solutions to meet this situation could include: a no-dwell, no-brake, no coast (direct) solution in which the desired pulse width is achieved by using chosen acceleration and deceleration values to a rotate the servo valve to a stop at the end of the single pulse 0-1-0 cycle in such a manner as to achieve the required pulse width; a no-dwell, no-brake (coasting) solution in which the desired pulse width is achieved by using chosen acceleration and deceleration values to first rotate the servo valve to a stop, with an intervening period of coasting where the rotor is allowed to continue rotation but without any energy being delivered to the motor; a no-dwell (braked coasting) solution in which the desired pulse width is achieved by using acceleration and one or more deceleration values to rotate the servo valve to a stop and the end of the 0-1-0 cycle in such a manner as to generate the required pulse width, with an intervening period of coasting (optionally following a first braking/deceleration), with such coasting achieved by intermittently braking the motor so as to reduce the speed of the rotor, but not to stop its rotation; a dwell-time (paused) solution in which the desired pulse width is achieved by using a first acceleration and deceleration phase with first acceleration and deceleration values to rotate the servo valve to a stop in the travel zone, followed by a chosen dwell time, and then further followed a second acceleration and deceleration phase with second acceleration and deceleration values to rotate the servo valve to a second stop at the end of 0-1-0 cycle, this generating the desired pulse width; and a coasting dwell-time (coasting paused) solution in which the desired pulse width is achieved by using a first acceleration and deceleration phase with first acceleration and deceleration values to rotate the servo valve a stop in the travel zone, with an intervening chosen period of coasting where no energy is delivered to the motor, thus allowing it to decelerate naturally to a full stop in the travel zone, subsequently followed by a dwell time, and then a second acceleration and deceleration phase with second acceleration and deceleration values to further rotate the servo valve to a second stop at the end of the 0-1-0 cyele, with a intervening chosen period of coasting so as to allow the servo valve to close the servo holes at the end of the pulse cycle in such a manner as to coast to the stop and simaltaneously achive the desired pulse width.

In an embodiment, the rotor can coast or stop/pause within its sweep arc in a travel zone where the servo tips do not obstruct the servo holes.

In an embodiment, the rotor can coast or stop/pause within its sweep arc in the sweep zone in suach a manner as to partially onstruct the servo holes in either opening phase of the pulse cycle or the closing phase of the pulse cycle.

In an embodiment in which four servo holes are provided, and there are four servo tips for obstructing them, the rotor can coast or stop/pause within its sweep arc in a travel zone of about 20-25 degrees, or about 22 degrees, in extent. The travel zone may centered at about midway through the 90-degree sweep arc and thus be positioned at about 34 to 56 degrees from a starting point.

In many MWD systems, the pulse command is sent as a digital voltage signal on a single wire so as to command the opening of the servo valve with a rising edge of the digital voltage signal and the closing of the servo valve with a falling edge of the digital voltage signal. In this instance, the rising edges/falling edges operate as a command to the motor to activate and thus to rotate the shaft and rotor and associated structures in the desired direction. In most system such pulse signals and the required pulse widths do not change and a single width of pulse is required, albeit at varying times. In this situation, the first time a pulse command is sent on the digital voltage signal, the microcontroller in the servo pulser has no a-priori knowledge of the required pulse width as it is required to begin rotation when the digital signal transitions from a low state to a high state, and may not be able to initiate the closure of the servo valve until a high to low transition is seen on the digital voltage signal. In this situation, the microcontroller in the pulser may be forced to generate an imperfect pulse as best it as it can using algorithmic defaults. However, in this situation, the microcontroller in the servo pulser may store the results of the first pulse, including information regarding the required pulse width (as measured by the time between the rising and falling edge of the digital voltage signal), times related to acceleration, deceleration, coasting, dwelling or stopping as may be required, and use this information to generate the next pulse at the required pulse width (which is assumed to be the same as the first pulse width) using the data thus measured and saved.

In some MWD systems, digital communication (bus) commands may be sent to initiate the servo pulser to generate a pulse of the required pulse width. If such a bus command is sent with the width of the desired pulse, and possibly other parameters as may be specified by the MWD system sending the bus command, the servo pulser can use data gathered and saved from previously generated pulses to accommodate different pulse widths as requested by the MWD system.

BRIEF DESCRIPTION OF THE FIGURES

FIGS. 7F-J show a second series of opening/closing states of the servo pulser in the reverse order as in FIGS. 7A-E.

DETAILED DESCRIPTION OF THE INVENTION

In one embodiment of the invention, as described in detail below, information of use to the driller is measured at the bottom of a borehole relatively close to the drilling bit and this information is transmitted to the surface using pressure pulses in the fluid circulation loop that manifest as pulses in the surface pressure. The command to initiate the transmission of data may be sent by stopping fluid circulation and allowing the drill string to remain still for a minimum period of time. Upon detection of this command, the downhole tool measures at least one downhole condition, usually an analog signal, and this signal is processed by the downhole tool and readied for transmission to the surface. When the fluid circulation is restarted, the downhole tool waits a predetermined amount of time to allow the fluid flow to stabilize and then begins transmission of the information by repeatedly closing and then opening the pulser valve to generate pressure pulses in the fluid circulation loop. The sequence of pulses sent is encoded into a format that allows the information to be decoded at the surface and the embedded information extracted and displayed.

Figure 1A:
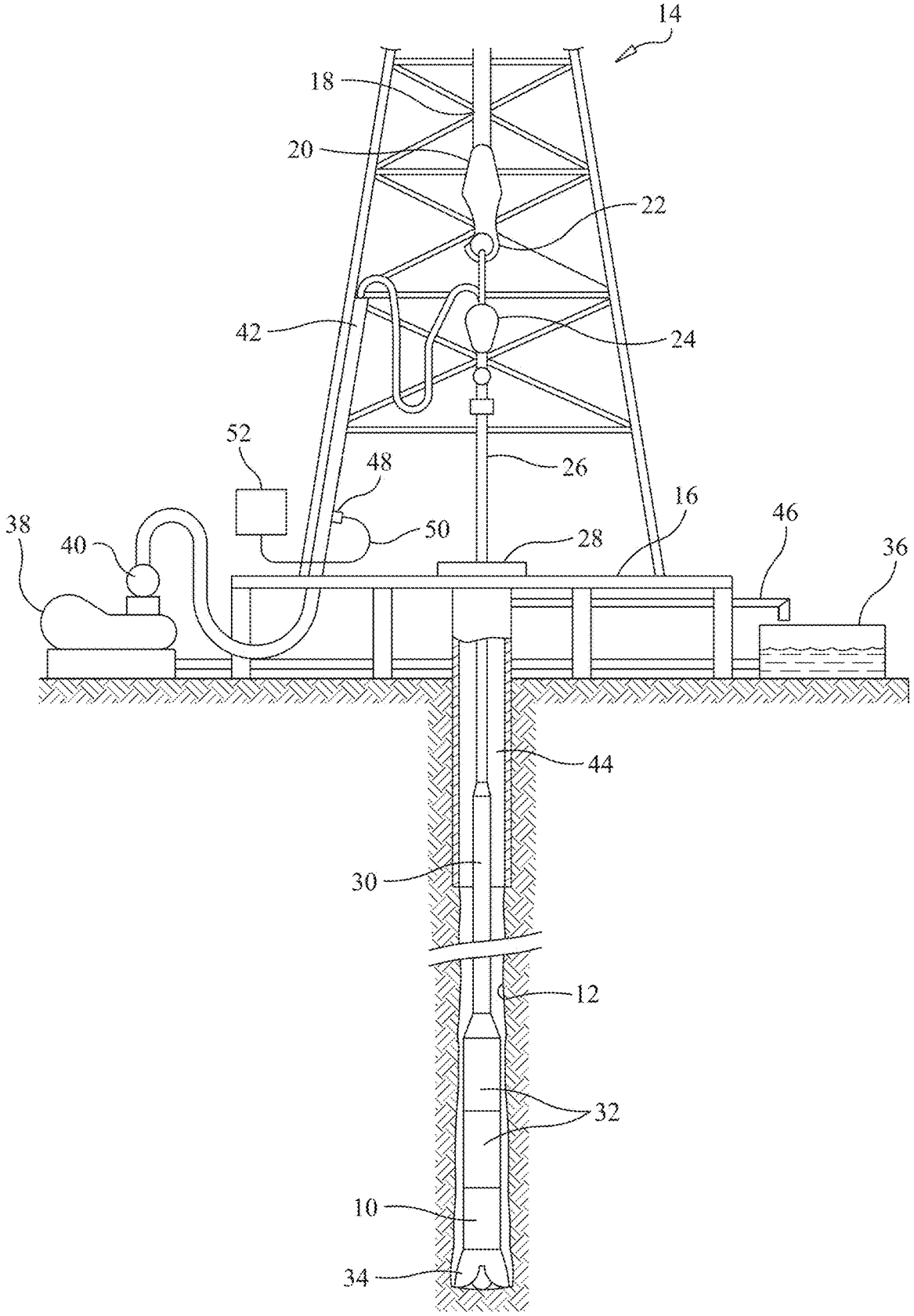
FIG. 1A is a representative view of parts of the surface and downhole portions of a drilling rig.

Referring now to the drawings and specifically to FIG. 1A, there is generally shown therein a simplified sketch of the apparatus used in the rotary drilling of boreholes 12. A borehole 12 is drilled into the earth using a rotary drilling rig which consists of a derrick 14, drill floor 16, draw works 18, traveling block 20, hook 22, swivel joint 24, kelly joint 26 and rotary table 28. A drill string 30 used to drill the bore well is made up of multiple sections of drill pipe that are secured to the bottom of the kelly joint 26 at the surface and the rotary table 28 is used to rotate the entire drill string 30 while the draw works 18 is used to lower the drill string 30 into the borehole and apply controlled axial compressive loads. The bottom of the drill string 30 is attached to multiple drilling collars 32, which are used to stiffen the bottom of the drill string 30 and add localized weight to aid in the drilling process. A measurement while drilling (MWD) tool 10 is generally depicted attached to the bottom of the drill collars 32 and a drilling bit 34 is attached to the bottom of the MWD tool 10.

The drilling fluid or "mud" is usually stored in mud pits or mud tanks 36, and is sucked up by a mud pump 38, which then forces the drilling fluid to flow through a surge suppressor 40, then through a kelly hose 42, and through the swivel joint 24 and into the top of the drill string 30. The fluid flows through the drill string 30, through the drill collars 32, through the MWD tool 10, through the drilling bit 34 and its drilling nozzles (not shown). The drilling fluid then returns to the surface by traveling through the annular space 44 between the outer diameter of the drill string 30 and the well bore 12. When the drilling fluid reaches the surface, it is diverted through a mud return line 46 back to the mud tanks 36.

The pressure required to keep the drilling fluid in circulation is measured by a pressure sensitive transducer 48 on the kelly hose 42. The measured pressure is transmitted as electrical signals through transducer cable 50 to a surface computer 52 which decodes and displays the transmitted information to the driller.

Figure 1B:
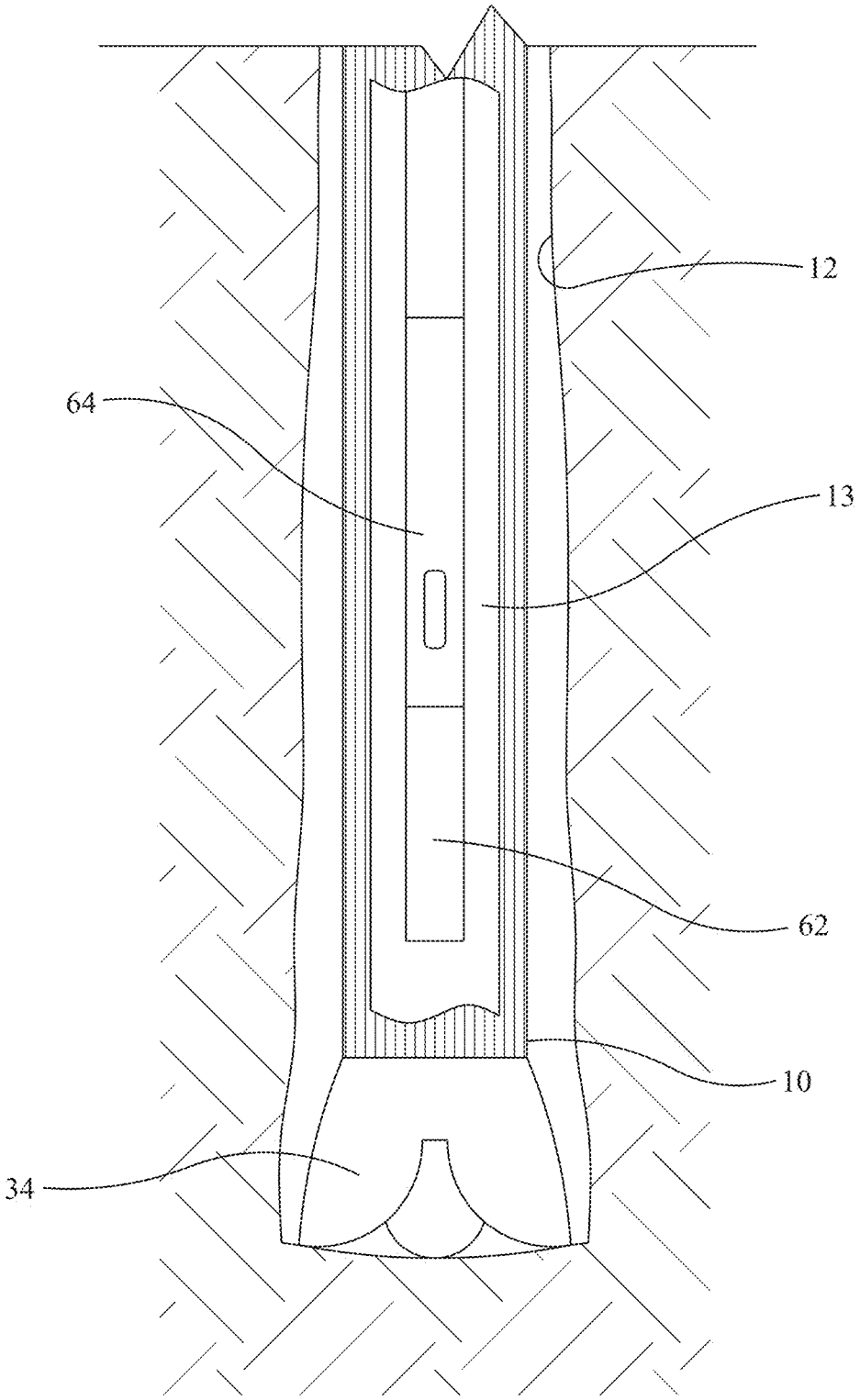
FIG. 1B is a partial cutaway of the upper portion of the MWD tool as shown in FIG. 1A.

FIG. 1B shows a partial cutaway of the upper portion of the MWD tool 10 to reveal pulser 62 (main pulser, main valve) connected to servo pulser 64. Both are located within the inner diameter of MWD tool 10. The one end of pulser 62 is connected to servo pulser 64 to create a path for drilling fluid between those components. The other end of pulser 62 is in contact with the internal drilling fluid column 13 within the inner diameter of MWD tool 10.

Figure 1C:
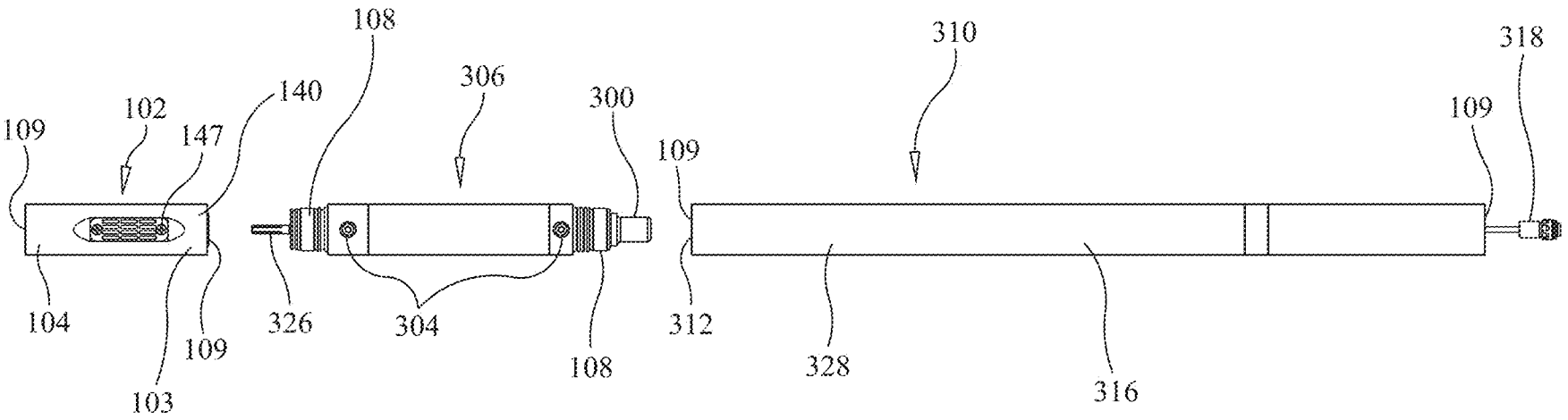
FIG. 1C shows a front view of portion of a servo pulser showing several sections separated from one another.
Figure 2:
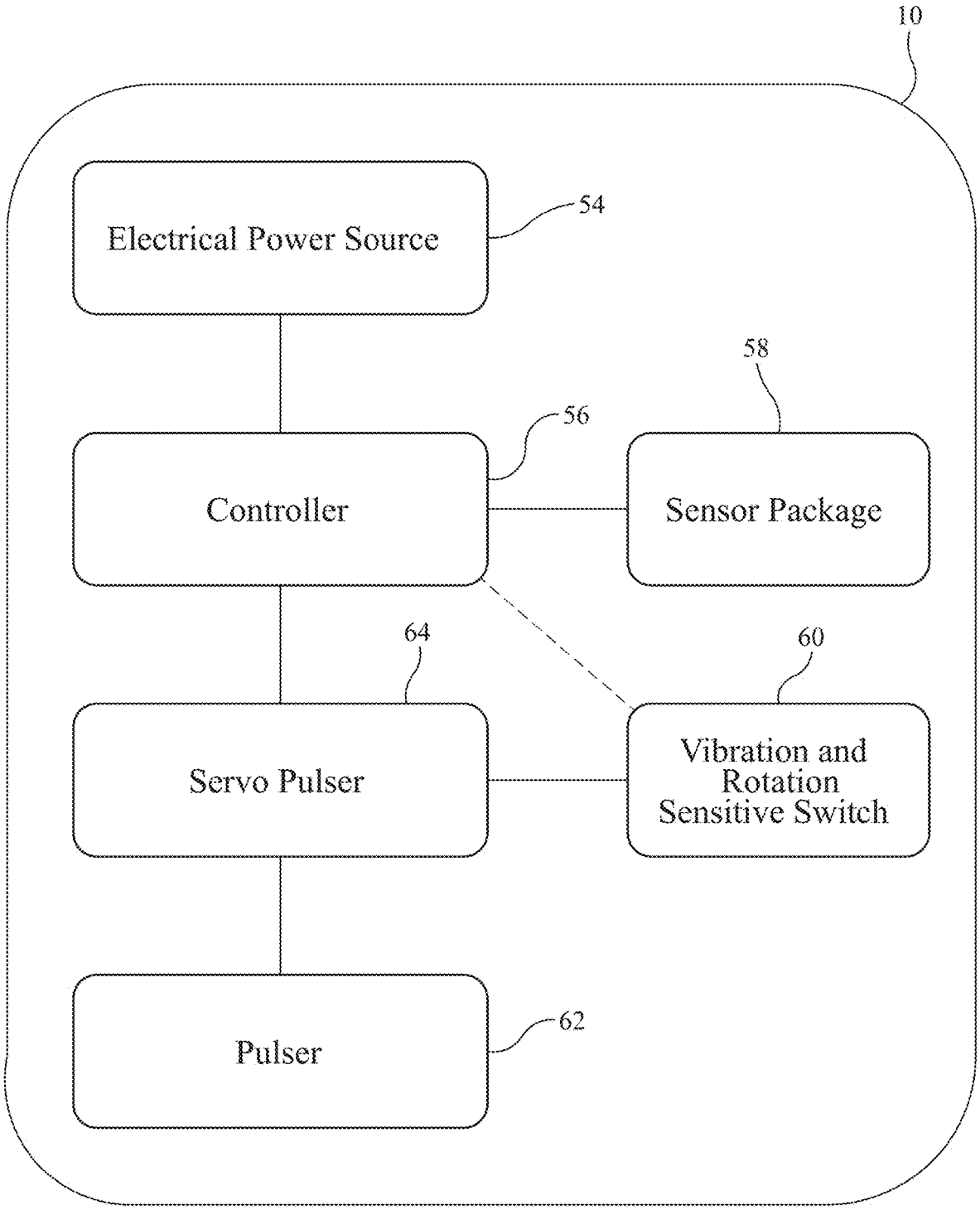
FIG. 2 is a representative view of the various components that together may comprise the downhole portion of an MWD tool.

FIG. 1C shows servo pulser 64 with the several sections separated from one another for clarity. Servo nozzle housing 102 is hydraulically and mechanically attached to pulser 62 at its first end via female connector 109, and mechanically to a first end of compensator housing 306 at its second end, so that servo shaft 126 and be driven therefrom through keyed end 127 which is permanently attached to servo shaft 126. Second end of compensator housing 306 is mechanically attached via male connector 108 and female connector 109 to a first end of electronics housing 310, and second end of electronics housing 310 is mechanically and electrically attached as part of MWD tool 10. FIG. 2 generally shows a schematic representation of the various components that together make up the downhole portion of an MWD tool. The downhole MWD tool 10 consists of an electrical power source 54 coupled to controller 56. Controller 56 is coupled to sensor package 58 and servo pulser 64. The servo pulser 64 is coupled to a vibration and rotation sensitive switch 60 and a pulser 62.

FIG. 2 shows one embodiment of the method of the MWD tool. Another embodiment (not depicted) is one in which the vibration and rotation sensitive switch 60 is integrated into the servo pulser 64. Another embodiment (not depicted) is one in which controller 56 is integrated into the servo pulser 64 which is directly connected to sensor package 58.

Controller 56 in FIG. 2 has the ability to be alerted or informed of the status of the vibration and rotation present in the drill string either by directly communicating to the vibration and rotation sensitive switch 60 or by having this information transmitted through the servo pulser 64. The vibration and rotation sensitive switch 60 can be integrated into the controller 56 and can thereby acquire this information directly.

Figure 3A:
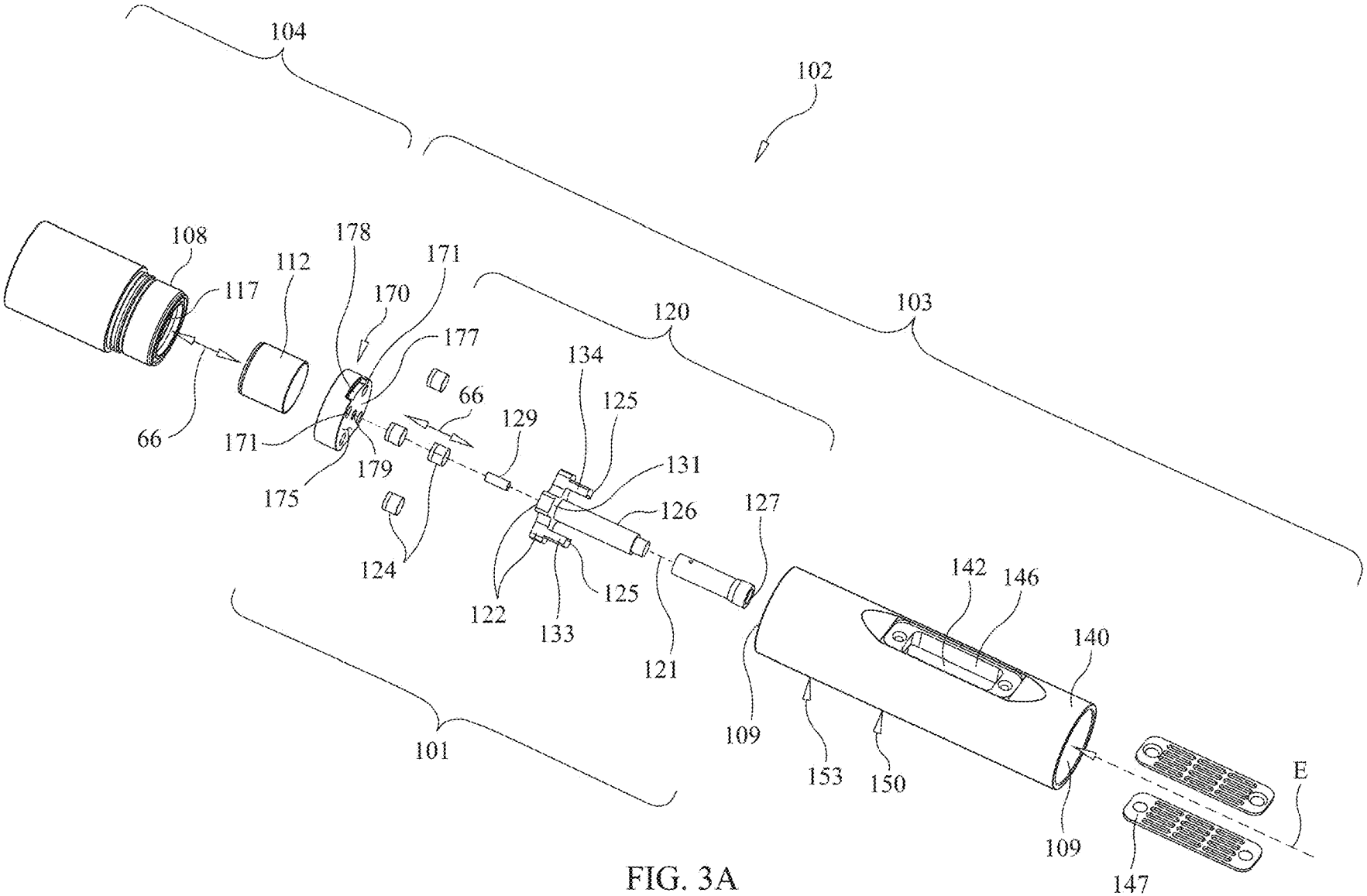
FIG. 3A shows a right, front, top, oblique exploded view of a portion of an embodiment of the invention.
Figure 3B:
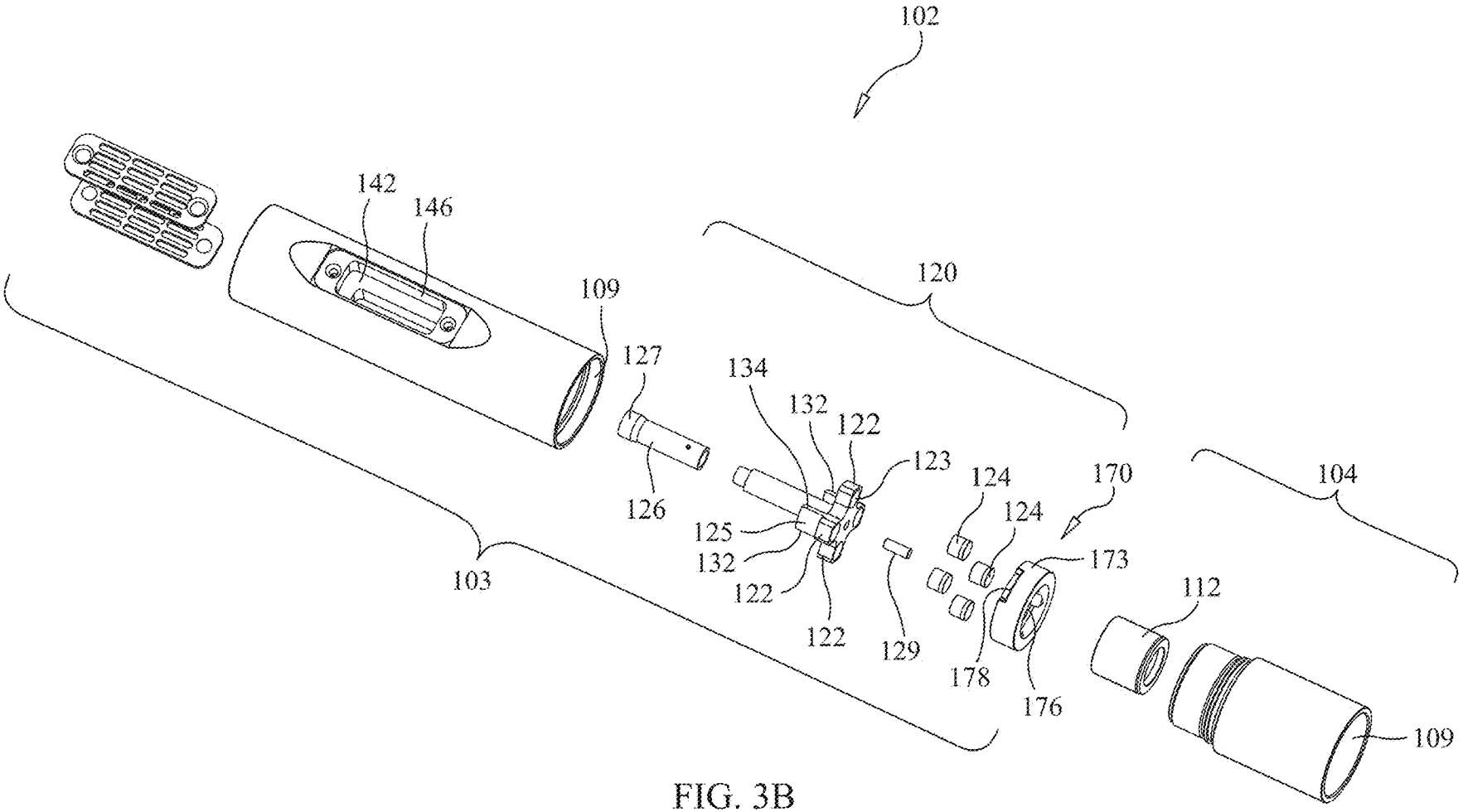
FIG. 3B shows a left, rear, top, oblique exploded view of portion of the embodiment of the invention shown FIG. 3A.
Figure 4A:
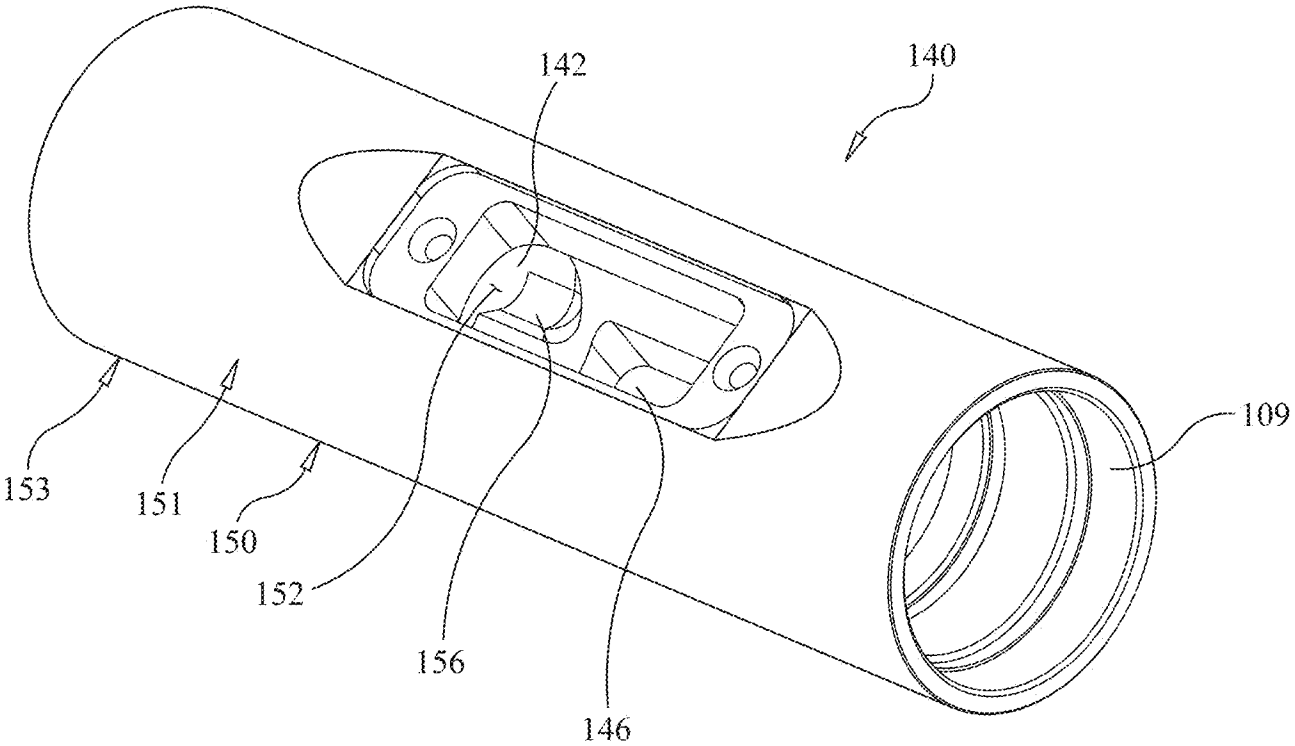
FIG. 4A shows a right, front, top, oblique view of a servo screen housing of an embodiment of the invention.
Figure 4B:
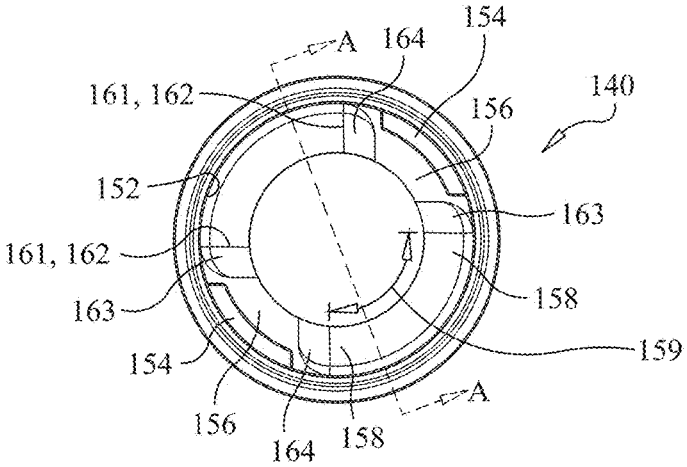
FIG. 4B shows a left elevation of the screen housing in FIG. 4A.
Figure 4C:
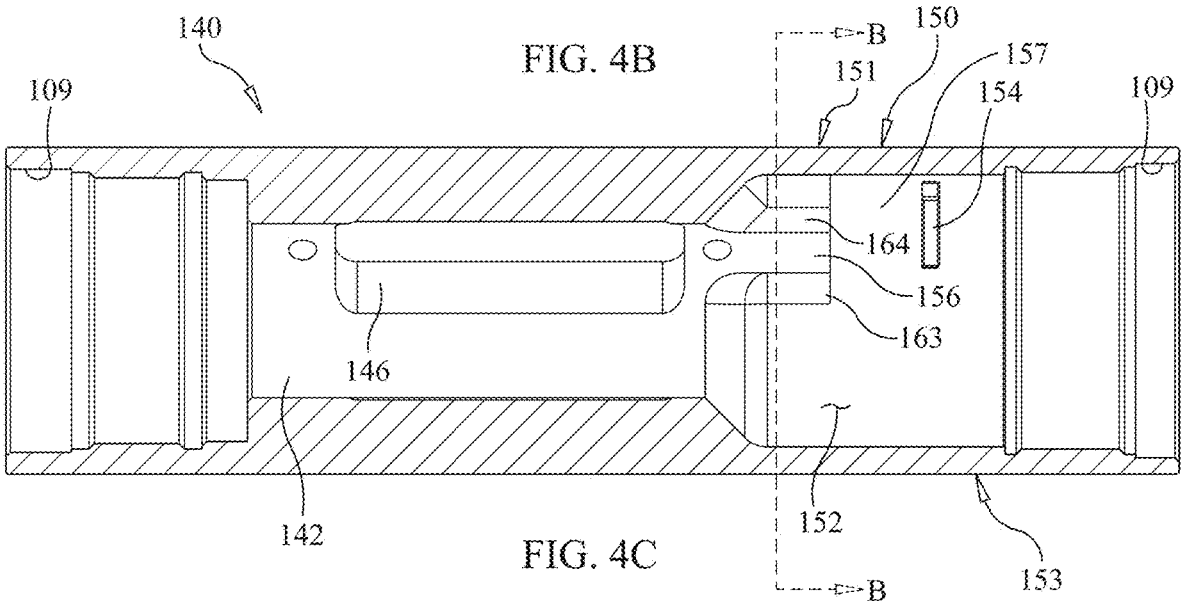
FIG. 4C shows a section view along line A-A from FIG. 4B.
Figure 4D:
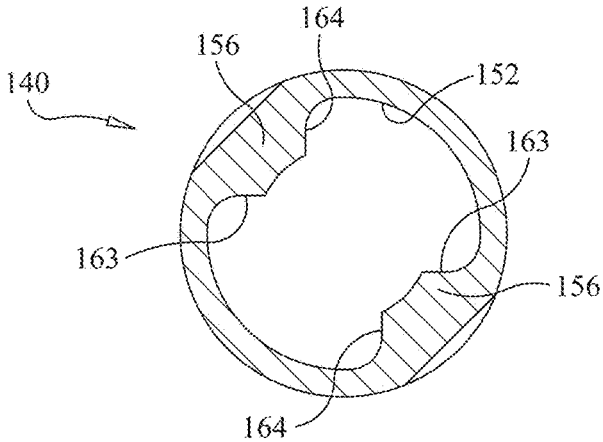
FIG. 4D shows a section view along line B-B from FIG. 4C.
Figure 5A:
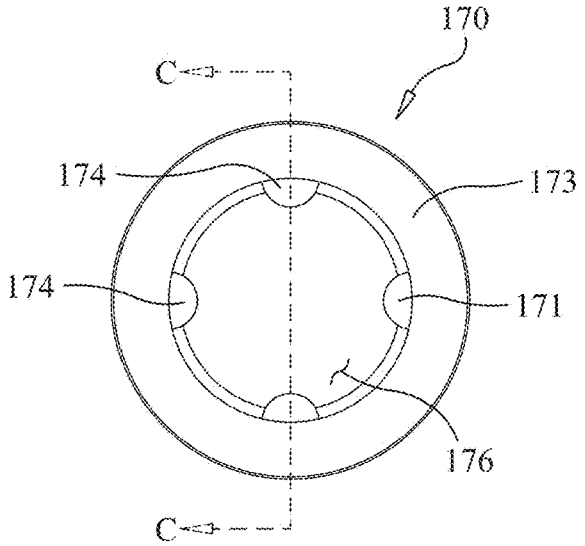
FIG. 5A shows right elevation of a servo seat of an embodiment of the invention.
Figure 5B:
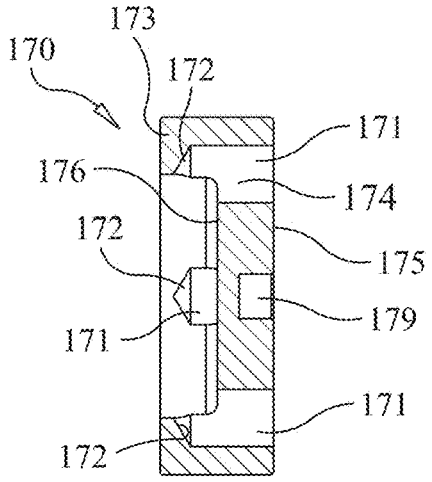
FIG. 5B shows a section view along line C-C from FIG. 5A.
Figure 6A:
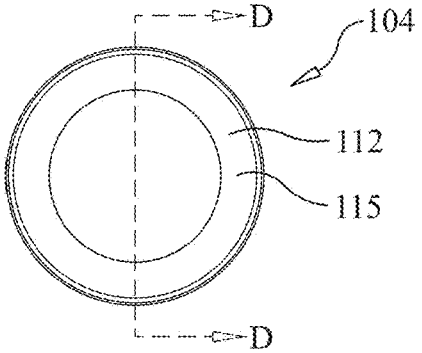
FIG. 6A shows left elevation of a nozzle insert of an embodiment of the invention.
Figure 6B:
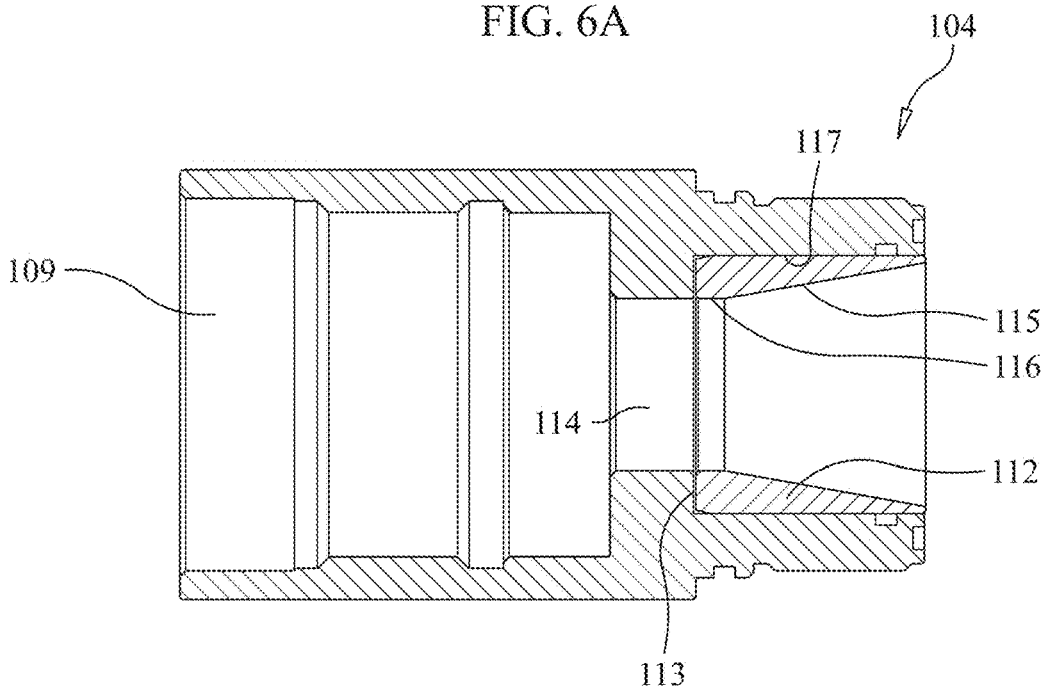
FIG. 6B shows a section view along line D-D from FIG. 6A.
Figure 7C:
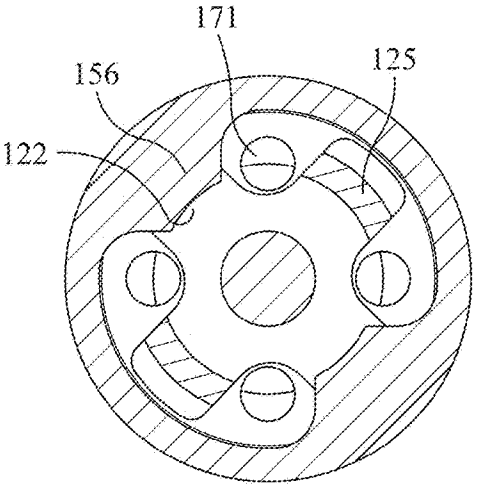
FIGS. 7A-E show a series of opening/closing states of the servo pulser as viewed along internal sightline E in FIG. 3A.
Figure 7B:
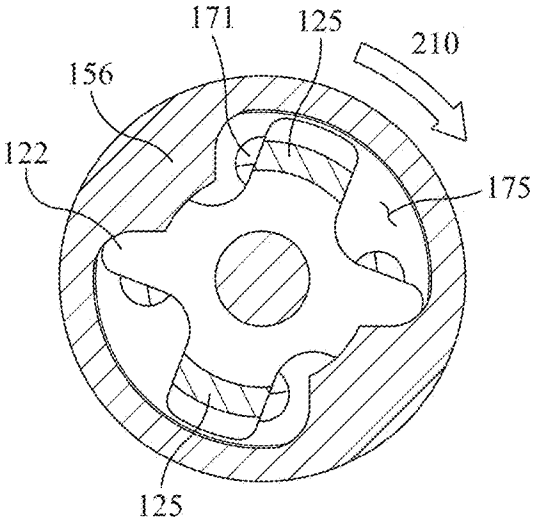
Figure 7A:
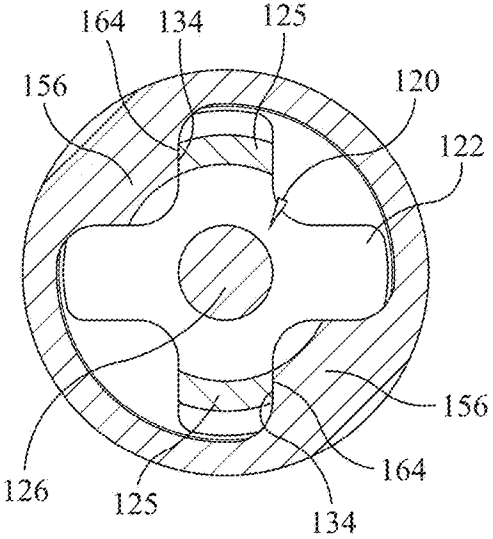
Figure 7E:
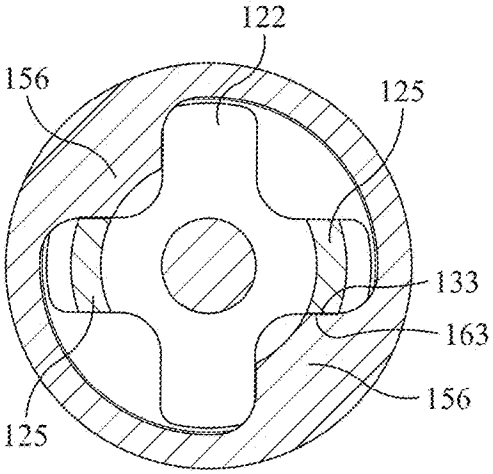
Figure 7D:
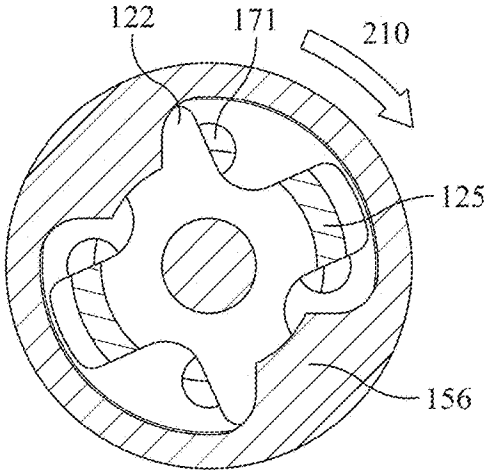

Returning to FIG. 1C, and with reference to FIGS. 3A-3B, in an embodiment of the invention, servo nozzle housing 102 includes screen housing 103 and nozzle bulkhead 104, with servo valve 101 within screen housing 103. Screen housing 103 includes fluid inlets 146 in this embodiment, two thereof, spaced about the circumference of screen housing 103, and which are screened by servo screens 147 as a filtering/screen mechanism to restrict large particulate matter as are sometimes present in the drilling fluid 66 from entering into fluid inlets 146. Fluid inlets 146 allow drilling fluid to enter screen housing 103 and be hydraulically connected to/from servo valve 101 via central channel 142, and through valve 101, and via valve 101 to nozzle bulkhead 104 and then on to pulser 62.

Compensator housing 306 encloses a dual shaft gearbox (not shown) for coupling to and driving servo shaft 126 by drive shaft 326 via keyed end 127, drive shaft 326 being located at a first end of compensator housing 306. The gearbox is attached at its second end to magnetic bulkhead 308 via a shaft through a piston compensator (not shown). Oil fill plugs 304 are provided in compensator housing 306 to permit filling the interior thereof with hydraulic oil for lubrication and pressure compensation, that is, to balance internal oil pressure on gaskets and seals with the exterior fluid pressure. Compensator housing 306 includes a piston compensator exposed to the pressure of the drilling fluid on one upstream side and transmitting that pressure to compress the oil-filled interior of compensator housing 306. Magnetic bulkhead 308 also includes a coupling device (not shown) to transmit torque between to drive shaft 326 (via a dual-shaft gearbox) from electronics housing 310 through the use of a plurality of magnets on compensator housing 306 matched to a plurality of magnets on magnetic coupling 312 of electronics housing 310. That magnetic coupling device drives one end of the dual-shaft gearbox resident inside compensator housing 306, the other end of the dual-shaft gearbox being connected to drive shaft 326.

Electronics housing 310 includes magnetic coupling 312 at its first end, connected to electric motor 328. Electronics housing 310 includes motor driver 316, and at its second end includes mechanical connections and electrical connection 318. Connection 318 allows servo pulser 64 to be mechanically and electrically connected to controller 56 or electrical power source 54 or in general, to other components that may make up part of MWD tool 10.

Turning to FIGS. 3A, 3B, and 4A-4D, in an embodiment of the invention, screen housing 103 includes female connectors 109 on each end of body 140, valve section 150 at the end adjacent to nozzle bulkhead 104, and with fluid inlets 146 between valve section 150 and female connector 109 that connects to electronics housing 310. Central channel 142 creates a connecting space down the center of body 140 fluidically connecting fluid inlets 146 to valve section 150. That fluidic connection allows drilling fluid 66 to reach servo valve 101. Central channel 142 also is a space for servo shaft 126 to pass axially toward female connector 109 connected to electronics housing 310 to permit keyed end 127 to be connected to and driven by drive shaft 326.

Valve section 150 of screen housing 103 contains servo valve 101 positioned within valve section 150, which includes servo seat retainer 153 and dl, with rotor section 151 being more proximal to fluid inlets 146 and between valve seat retainer 153 and fluid inlets 146. Servo valve 101 includes servo rotor 120 and servo seat 170.

Servo rotor 120 is placed inside rotor section 151 and includes servo shaft 126, with keyed end 127, and rotor arms 122, each having a common axis of rotation 121. Rotor arms 122 are lateral extensions reaching radially off axis of rotation 121 of servo shaft 126. Rotor arms 122 include servo tips 124 attached thereto, e.g. by means of an interference press fit, into tip holes 123 formed on valve seat side 130 of rotor arms 122. Servo tips 124 thus extend axially seat-wise from rotor arms 122 toward servo seat 170 and away from stops 156 and fluid inlets 146 and servo shaft 126. Rotor arms 122 also include digits 125 either formed thereon, or attached thereto, onto opposing stop side 131 thereof. Digits 125 thus extend axially stop-wise from rotor arms 122 away from servo seat 170 and toward stops 156 and fluid inlets 146 and servo shaft 126, and in the opposing direction of servo tips 124. Digits 125 include opposing faces substantially tangent to the directions of rotation, clockwise CW face 133 and counter-clockwise CCW face 134. In this embodiment, there are four rotor arms 122, each with one servo tip 124, but only two digits 125, rotor arms 122 with a digit 125 are separated from one another by another one rotor arm 122 without a digit 125. In addition, dowel pin 129 is also attached to servo shaft 126 on axis of rotation 121, e.g., by means of an interference press fit for fitting into rotor pin hole 179 of servo seat 170.

Turning to FIGS. 3A, 3B, 4A-4D, and 5A-5B, in an embodiment of the invention, servo seat 170 is set within cylindrical servo seat retainer 153 and includes rotor face 175, facing servo rotor 120, and opposing nozzle face 176. Servo holes 171 pass through servo seat 170 from rotor face 175 to nozzle face 176. Servo seat 170 also includes rotor pin hole 179 at the center thereof on rotor face 175, and keyholes 178 depressed into the outer edge of rotor face 175 for locking into anti-rotation keys 154 of servo seat retainer 153 on the interior of servo screen housing 103. Nozzle face 176 of servo seat 170 includes axially-extending peripheral ring 173. Ring 173 extends axially toward nozzle bulkhead 104. Ring 173 extends from at or about the outer periphery of servo seat 170 to at or about 30% of the radius of ring 173, and is broad enough to occlude a fraction, at or about 50% of the axially-oriented flow area 174 of servo holes 171. Servo holes 171 are circular on rotor face 175, and spaced about symmetrically radially outward of rotor pin hole 179 and inward of the outer edge of servo seat 170. Rotor face 175 includes travel zones 177, being the portions of rotor face 175 not pierced by servo holes 171 and over which servo tips 124 can pass in rotational fashion without occluding servo holes 171. Servo holes 171 extend axially through nozzle face 176 but are roughly semi-circular as viewed axially, being partially occluded by the inner edge of ring 173. Servo holes extend axially past nozzle face 176 and terminate in angled flow redirect 172, which acts to turn the flow of drilling fluid 66 from essentially axial at rotor face 175 to partially radially inwardly beyond nozzle face 176 to direct flow into nozzle insert 112.

In operation, servo tips 124 are pressed onto rotor face 175 of servo seat 170 and are located radially by guiding dowel pin 129 into rotor pin hole 179. In this manner, servo shaft 126, rotor arms 122, and servo tips 124 are located to the servo seat 170 to allow servo shaft 126 to be rotated relative to servo seat 170 and servo holes 171.

Servo seat 170 and servo tips 124 are preferably made out of a hard material to provide significant resistance to erosion and wear caused by the repeated opening and closing of said servo valve 101. Some such materials can be made from cemented ceramics or carbides such as aluminum oxide, silicon carbides, tungsten carbides. Although such hard materials are generally better in applications, it can be seen that in some embodiments, standard metal or plastic components may be used as a means to reducing manufacturing costs. Having the edge of the servo tip 124 be sharp where it is in contact with servo seat 170 significantly adds to the cutting and sweeping ability of the servo valve 101. The action of rotating the servo shaft 126 in effect causes the sharp knife-like edge of the servo tips 124 to sweep across rotor face 175 of servo seat 170 and thereby cut any contaminants that may be obstructing servo holes 171. This shearing action is highly desirable in MWD applications where additives and contaminants in the drilling mud may frequently cause jams in some equipment.

Rotor section 151 includes stops 156 to limit rotation of servo rotor 120. Stops 156 are mechanical and rotationally fixed with respect to valve seat 170 and rotor section 151 of screen housing 103 and extend partially radially inward of the outer diameter of the servo seat. Stops 156 are formed on interior surface 152 of rotor section 151 of screen housing 103 and extend radially-inwardly along only some portions of the circumferential extent of screen housing 103 and extend axially toward servo seat 170 only around halfway of the axial extent of rotor section 151. Stops 156 have both a clockwise CW surface 163 and a counter-clockwise CCW surface 164. Each of CW surface 163 and CCW surface 164 may contact digits 125.

By extending inwardly for only some portions of that circumferential extent, stops define two arcuate sweep zones 158 of around 90 degrees or exactly 90 degrees, and which are rotationally fixed with respect to valve seat 170 and rotor section 151. Sweep zones 158 define an about or exactly 90-degree sweep arc 159 in which servo rotor 120 is permitted to move between starting points 161 and stopping points 162 (see FIG. 4B). The two digits 125, extending axially away from servo seat 170, and stops 156 extend axially toward servo seat 170 sufficiently for digits 125 to contact stops 156 and for stops 156 to create limited rotation of servo rotor 120. Thus, each digit 125 extends into one of the two sweep zone 158 formed in rotor section 151 by stops 156, and the interaction between stops 156 and digit 125 in sweep zone 158 limits rotation of servo rotor 120 to sweep arc 159.

As stops 156 extend axially toward servo seat 170 only around halfway of the axial extent of rotor section 151, rotor section 151 also defines cylindrical open area 157, in which rotor arms 122 and servo tips 124 can rotate unobstructed (though their rotation is limited by interaction of stops 156 and digits 125).\

Starting points 161 and stopping points 162 may be created by mechanical interaction of matching faces on the stop and axially-extending digits on the arms of the rotor. In particular, a first (or clockwise "CW") stopping point 162 is caused by mechanical interaction of CW faces 133 of digits 125 with a CW surface 163 on stop 156 on rotor section 151 at the CW end of a sweep zone 158. A second (or counter-clockwise "CCW") stopping point 162 is caused by mechanical interaction of CCW faces 134 of digits 125 with a CCW surface 164 on stop 156 on rotor section 151 at the CCW end of a sweep zone 158. These stopping points 162 thus define the permitted sweep arc 159 and are then starting points 161 when the direction of rotation or rotor section 151 is reversed.

Turning to FIGS. 3A, 3B, 6A-6B, in an embodiment of the invention, nozzle bulkhead 104 includes male connector 108 for connection to screen housing 103 and female connector 109 for connection to pulser 62. Cylindrical insert receiver 117 is formed adjacent or within female connector 109 to receive cylindrical nozzle insert 112 which seats on insert seat 113. Nozzle insert 112 includes reducer section 115 in which the cross-sectional flow area reduces to transition section 116, which is at or about the same size as throat 114 formed through insert seat 113. Flow of drilling fluid 66 can thus flow through nozzle insert 112, throat 113 and into female connector 109 to continue to pulser 62.

Turning to FIGS. 4, 7A-7J, and FIGS. 8-10, pulse (or pressure pulse) 200 is experienced in surface pressure 220 of drilling fluid 66 in communication with the pulser 62. Pulse 200 includes: (i) low-pressure state 221 (0-signal 226), as a substantially stable lower pressure associated with servo tips 124 obstructing servo holes 171 and with being at one of starting point 161; (ii) pressure increase transition 222, associated with servo tips 124 progressively opening up servo holes 171 as they rotate with rotor 120; (iii) high-pressure state 223 (1-signal 227), as a substantially stable and increased pressure, associated with servo tips 124 having fully opened up servo holes 171; (iv) pressure drop transition 224, associated with servo tips 124 progressively closing off servo holes 171 as they rotate with rotor 120; and (v) a return to low-pressure state 221 (0-signal 226), associated with servo tips 124 obstructing servo holes 171 and with being at one of stopping points 164. The period of time during which digital voltage signal 205 is at its high voltage state 227 is digital pulse width 201. The period of time between when pulser 62 starts to open and when pulser 62 starts to close is hydraulic pulse width 202, which corresponds closely to the period of time surface pressure 220 shows an increasing value before dropping off, thus pressure increase transition 222 and high-pressure state 223.

In an embodiment, digital pulse width 201 may be at or about 1 s, at or about 0.5 s, at or about 0.25 s, or at or about 0.1 s. In an embodiment, hydraulic pulse width 202 may be narrower, equal or wider than the associated digital pulse width 201 that causes the pulse 200 to be generated, with the difference in time explained by the lag between the onset of the digital voltage signal's transition to a high state or subsequently to a low state and the associated delay to the opening or subsequent closing of the servo tips 124 over servo holes 171.

Figure 8:
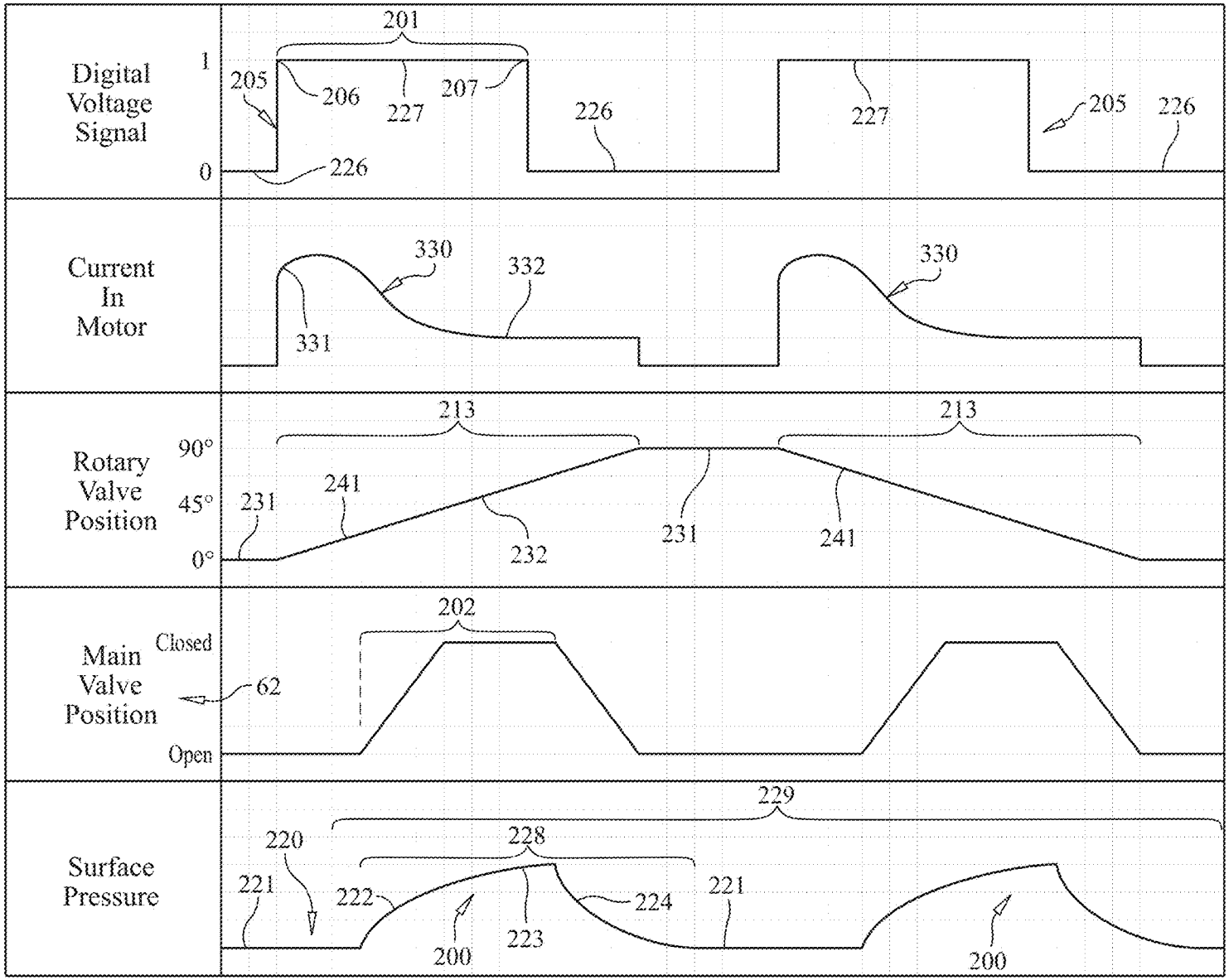
FIG. 8 shows interrelationships between certain operational statuses and actions of an embodiment of the invention in a first process.

FIG. 8 details the behavior of an embodiment of the current invention as it pertains to the operation of servo valve 101 in situations where servo rotor 120 of servo valve 101 moves continuously between starting and stopping points 161 and 162 without any coasting, braking or stops. Servo rotor 120 accelerates and travels continuously in one direction from servo tips 124 fully closing servo holes 171, to first rotate servo tips 124 to fully open servo holes 171, then continues to rotate to servo tips 124 then subsequently close and fully obstruct servo holes 171, changing rotary valve position from 0-degrees to 90-degrees. This action begins in closed state 231 and is followed by acceleration event 241 upon the reception of rising edge 206 of digital voltage signal 205. Current spike 331 in motor current 330 reflects power being applied to motor 238, followed by falling current 332. This acceleration causes servo rotor 120 to rotate to its open position 232 where servo tips 124 are in travel zone 160 in which servo holes 171 are not obstructed, initiating pulse 200. Servo rotor 120 continues to further rotate away from starting point 161 and causes servo tips 124 to sweep over servo holes 171, first partially obstructing them and then onto fully obstructing them to fully close servo valve 101, thus ending pulse 200. As shown in FIG. 8, servo rotor 120 then moves continuously between starting and stopping points 161 and 162 in the reverse direction, as shown by it changing rotary valve position back from 90-degrees to 0-degrees. During this rotation in the reverse direction, a second pulse 200 is created.

Figure 9:
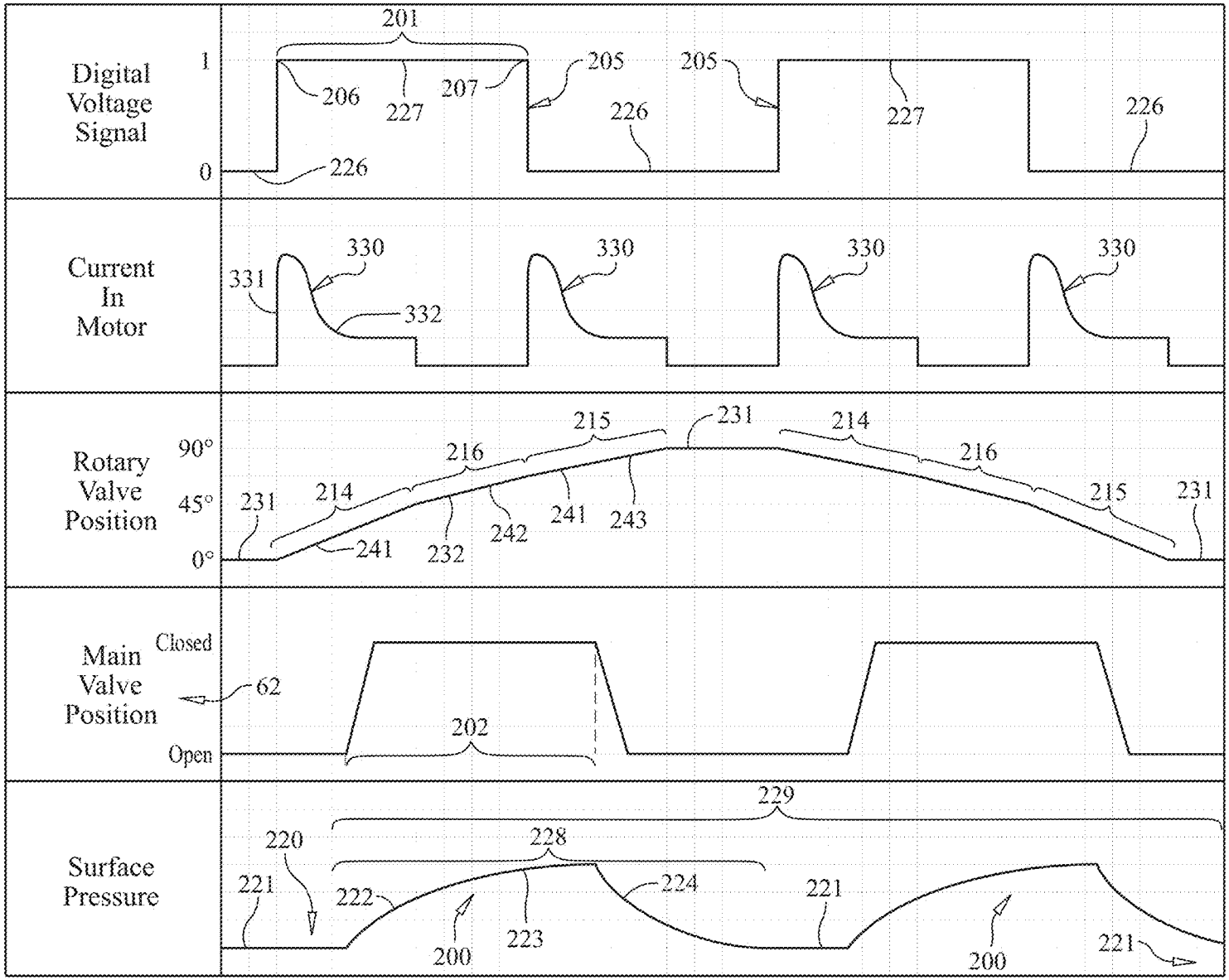
FIG. 9 shows interrelationships between certain operational statuses and actions of an embodiment of the invention in a second process.

FIG. 9 details the behavior of an embodiment of the current invention as it pertains to the operation of the servo valve in situations where servo rotor 120 of servo valve 101 moves in one direction to open servo holes 171 by rotating servo tips 124 from fully closing servo holes 171 to fully open servo holes 171. This action begins in closed state 231 and is followed by acceleration event 241 upon the reception of rising edge 206 of digital voltage signal 205. Current spike 331 in motor current 330 reflects power being applied to motor 238, followed by falling current 332. This acceleration causes servo rotor 120 to rotate to its open position 232 where servo tips 124 are in travel zone 160 in which servo holes 171 are not obstructed, beginning pulse 200. Servo rotor 120 then enters coasting phase 242 where motor 238 is not energized (current 330 flowing through the motor is zero), but the rotational inertia of the rotating portions of servo valve 101 (including servo rotor 120, servo tips 124, servo shaft 126) causes servo rotor 120 to continue to rotate, to coast, servo rotor 120 towards the edge of travel zone 160. Here, the rotary valve position of servo valve 101 changes, albeit at a slower rate than the opening portion of the pulse event. When falling edge 207 is detected on digital voltage signal 205, servo pulser 64 initiates second acceleration event 241, causing another current spike 331 in motor current 330, and causing servo rotor 120 to further rotate away from starting point 161 at a higher speed towards the end of sweep zone 158, and causes servo tips 124 to sweep over servo holes 171, first partially obstructing them and then onto fully obstructing them to fully close servo valve 101, thus ending pulse 200. Prior to the end of pulse 200, and slightly before the end of the required rotation, servo pulser 64 may enter into deceleration event 243, to cause servo rotor 120 to decelerate as it approaches stop 156, with the aim being to cause digits 125 to contact stop 156 at the end of pulse 200 with a minimum amount of force, this creating a reasonably optimal pulse event where energy consumption is minimized and unnecessary impacts to the servo valve and stop surfaces are minimized or avoided. As shown in FIG. 9, servo rotor 120 then moves between starting and stopping points 161 and 162 in the reverse direction, as shown by it changing rotary valve position back from 90-degrees to 0-degrees. During this rotation in the reverse direction, a second pulse 200 is created.

Figure 10:
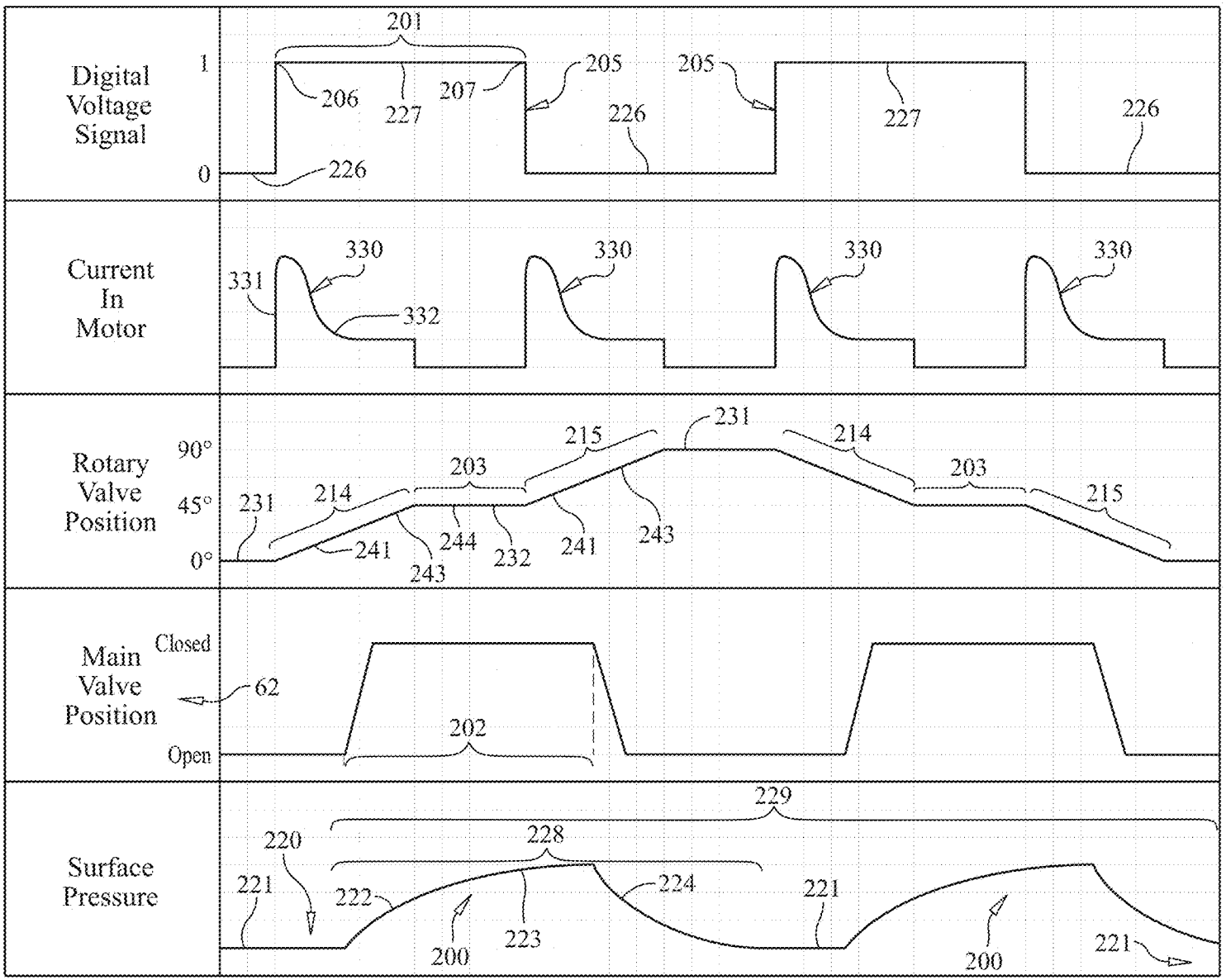
FIG. 10 shows interrelationships between certain operational statuses and actions of an embodiment of the invention in a third process.

FIG. 10 details the behavior of an embodiment of the current invention as it pertains to the operation of servo valve 101 in situations in which servo rotor 120 of servo valve 101 moves in one direction to open servo holes 171 by rotating servo tips 124 from fully closing servo holes 171 to fully open servo holes 171. This action begins in closed state 231 and is followed by acceleration event 241 upon the reception of rising edge 206 of digital voltage signal 205. Current spike 331 in motor current 330 reflects power being applied to motor 238, followed by falling current 332. This acceleration causes servo rotor 120 to rotate to its open position 232 where servo tips 124 are in travel zone 160 in which servo holes 171 are not obstructed, starting pulse 200. Servo pulser 64 may enter into deceleration event 243 prior to the full entry of servo tips 124 into travel zone 160 so as to cause the servo rotor 120 to stop rotation inside travel zone 160. Servo rotor 120 then enters intermediate stop phase 244 where motor 238 is not energized (current 330 flowing through the motor is zero), and motor 238 may be held in a brake state so as to stop its further rotation, this action being shows by the rotary valve position being steady and unchanging. Dwell time 203 is the period of time for which servo tips 124 are at rest and not obstructing servo holes 171; dwell time 203 thus enlarges pulse width 201. When falling edge 207 is detected on digital voltage signal 205, servo pulser 64 initiates a second acceleration event 241, causing current spike 331 in motor current 330, followed by falling current 332, and causing servo rotor 120 to further rotate away from starting point 161 at a higher speed towards the end of sweep zone 158, and causes servo tips 124 to sweep over servo holes 171, first partially obstructing them and then onto fully obstructing them to fully close servo valve 101, thus ending pulse 200. Prior to the end of pulse 200, and slightly before the end of the required rotation to fully close servo valve 101, servo pulser 64 may enter into deceleration event 243, to cause servo rotor 120 to decelerate as it approaches stop 156, with the aim being to cause digits 125 to contact stop 156 at the end of pulse 200 with a minimum amount of force, this creating a reasonably optimal pulse event where energy consumption is minimized and unnecessary impacts to the servo valve and stop surfaces are minimized or avoided. As shown in FIG. 10, servo rotor 120 then moves between starting and stopping points 161 and 162 in the reverse direction, with the same or other dwell time 203 as shown by it changing rotary valve position back from 90-degrees to 0-degrees. During this rotation in the reverse direction, a second pulse 200 is created. In this embodiment, the act of stopping the rotation of the servo in the middle of a single sweep or pulse event may require up to two acceleration and two deceleration events, and may result in higher power consumption when compared to modes that utilize no coasting or stopping, but may enable proper pulse generation and required valve motion control in geometries where the travel zones inside the swept zones are narrow or just sufficient to retain the servo tips in the travel zone, thereby allowing servo pulser diameters while allowing the use of larger servo tips and servo holes.

In an embodiment, rotor 120 oscillates between stopping points 162 in alternating clockwise and counterclockwise sweeps 210. Each sweep 210 in a given direction creates one full pulse 200. Thus, each sweep 210 starts with servo pulser 64 in closed state 231, with servo tips 124 at rest and fully obstructing servo holes 171. Sweep 210 then passes through servo pulser 64 being in open state 232, with servo tips 124 at rest or in motion, and not obstructing servo holes 171. Sweep 210 then ends with servo pulser 64 back in closed state 231, with servo tips 124 at rest and fully obstructing servo holes 171. Sweep 201 may have a characteristic sweep rate 212, being the number of sweeps 210 in a unit time, ordinarily per second, as well as sweep time 213 being the time to complete one sweep 210.

In an embodiment, pulse rate 204 of servo pulser 64 is the same or substantially the same as sweep rate 212. That is, servo pulser 64 creates one full pulse 200 in one sweep 210 of rotor 120. In this embodiment, sweep time 213 also correlates to the time period required to complete one pulse (not pulse width 201).

In an embodiment, each sweep 210 in a given direction creates one full pulse 200. Each sweep 210 starts with rotor 120 at one of stopping points 162, with drilling fluid 66 at in low pressure state 221 indicating 0-signal 226, then drilling fluid 66 passing through pressure rise transition 222, then reaching high pressure state 223 indicating 1-signal 227, remaining at that pressure for pulse width 201, then drilling fluid 66 passing through pressure drop transition 224, then drilling fluid 66 returning to high pressure state 221 indicating 0-signal 226.

In an embodiment, rotor 120 oscillates between stopping points 162 in alternating clockwise/counterclockwise sweeps 210. Each sweep 210 in a given direction creates one full pulse, in a 0-signal-1-signal-0-signal progression (226-227-226) (or 0-1-0 progression 228). In an embodiment, servo pulser 64 creates a full pulse 200, rotor 120 beginning at a CCW stop 156 and rotating in a clockwise direction in 0-1-0 progression 228 and ending at CW stop 156. Then servo pulser 64 creates another full pulse 200, rotor 120 beginning at the CW stop 156 and rotating in a counterclockwise direction in 0-1-0 progression 228 and ending at the CCW stop 156.

In an embodiment, rotor 120 oscillates clockwise and then counterclockwise to create two consecutive pulses 200, in a 0-1-0-1-0 progression 229, beginning at the CCW stop 156 and rotating in a clockwise direction to the CW stop 156, then rotating in a counterclockwise direction from the CW stop 156 to the CCW stop 156.

In an embodiment with an intermediate stop, rotor 120 of servo pulser 64 oscillates between stopping points 162 in alternating clockwise/counterclockwise sweeps 210 with intermediate stop 244 (between stopping points 156) with servo pulser 64 in open state 232. Each sweep 210 in a given direction creates one full pulse 200. Each sweep 210 starts with electric motor 328 driving servo shaft 126, accelerating rotor 120 (acceleration 241) from closed state 231 of servo pulser 64 (servo tips 124 at rest and fully obstructing servo holes 171) towards servo pulser 64 being in open state 232. Then, after an optional coasting event 242, electric motor 328 then decelerates rotor 120 (deceleration 243) so that it stops for dwell time 203 with servo pulser 64 in open state 232 (servo tips 124 not obstructing servo holes 171), creating pulse width 201 of pulse 200. Then electric motor 328 accelerates 241 rotor 120 from open state 232 (in the same direction as the previous acceleration 241) towards servo pulser being in closed state 231. Then, after an optional coasting 242, electric motor 238 decelerates 243 rotor 120 so that it stops with servo pulser 64 in closed state 231 (servo tips 124 at rest and fully obstructing servo holes 171). Each sweep 210 is through sweep arc 159 of at or about 90 degrees and each such arc may include two acceleration events 241 and deceleration events 243. Dwell time 203 exists between first deceleration event 243 and second acceleration event 241, and coasting event 242 is, optionally, between acceleration events 241 and then deceleration events 243.

In an embodiment with no intermediate stop, rotor 120 of servo pulser 64 oscillates between stopping points 156 in alternating clockwise/counterclockwise sweeps 210 with no intermediate stop between stopping points 156. Each sweep 210 in a given direction creates one full pulse 200. Each sweep 210 starts with electric motor 238 driving servo shaft 126, accelerating 241 rotor 120 from closed state 231 toward servo pulser being in open state 232. Then, after an optional coasting event 242, electric motor 328 then optionally decelerates 243 rotor 120 to extend the time for which servo pulser 64 is in open state 232, creating pulse width 201 of pulse 200. Then electric motor 328 optionally accelerates 241 rotor 120 (in the same direction as the previous acceleration 241) toward servo pulser 64 being in a closed state 231. Then, after an optional coasting event 242, electric motor 328 decelerates 243 rotor 120 so that it stops with servo pulser 64 in closed state 231. Each sweep 210 is through sweep arc 159 of at or about 90 degrees and each such arc includes at least one acceleration event 241 and at least one deceleration event 243 and may include two of each. Any coasting event 242 exists, optionally, between acceleration event 241 and then deceleration event 243, and between deceleration event 243 and acceleration event 241.

Figure 11:
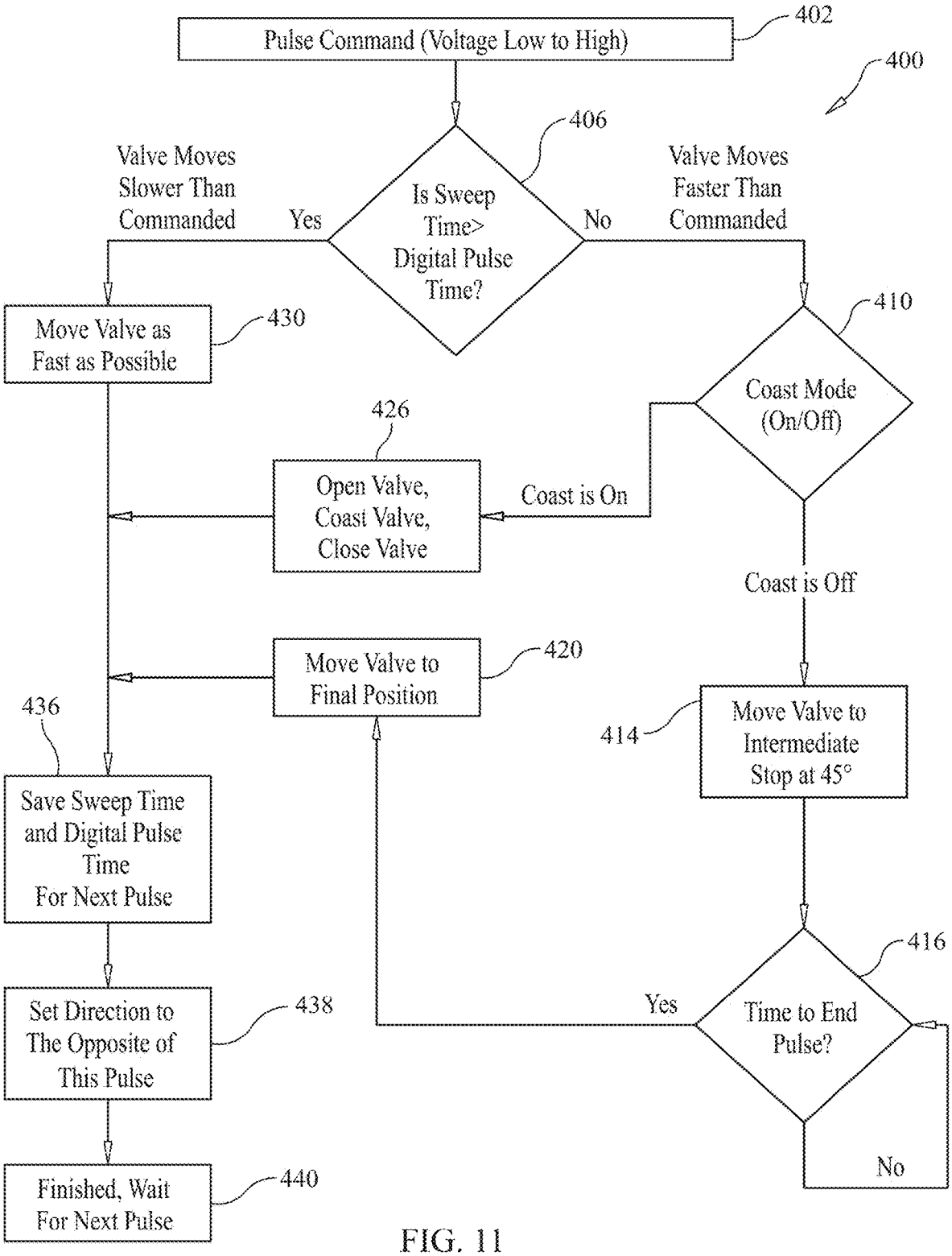
FIG. 11 shows steps of a process for carrying out an embodiment of the invention.

Turning to FIG. 11, in an embodiment, a microcontroller in servo pulser 64 carries out feedback/decision loop 400 between hyraulic pulses (and sweeps) to determine how fast or slow it should drive servo rotor 120, including if it should carry out an intermediate stop or carry out a coasting operation. Feedback/decision loop 400 computes and executes the desired velocity/acceleration, coasting or dwell profile, having received and/or calculated the time required to move the rotating portion of the valve, and other information on one or more previous pulses, such as sweep time 213, digital pulse width 201, applied current.

Loop 400 includes initiating pulse command 402, followed by slow/fast evaluation step 406 in which saved sweep time 213 (from the last pulse) is compared to digital pulse width 201 (from the last pulse). If sweep time 213 is not greater, then the valve closed faster than commanded, leading to coast mode check 410. If coast mode is off, then commands are issued to motor 328 to carry out an acceleration event 241 to drive servo rotor 120 to intermediate stop 244 in travel zone 160. Following that stop, pulse end check 416 checks if it is time to complete the pulse, e.g. if sufficient dwell time 203 has now elapsed that servo rotor 120 should be moved to the final position at stopping point 162. If the answer is no, it loops back to pulse end check 416 until it answers yes; if the answer is yes, final position order 420 causes the commands to be issued to carry out an acceleration event 241 to drive motor 328 to drive servo rotor 120 to stopping point 162, including an optional deceleration 243. If coast mode is on, then coasting process step 426 causes coasting event 242 to be carried out across servo holes 171 in place of intermediate stop 244 described above. If sweep time 213 is greater, then the valve closed more slowly than commanded, leading to the close fast command 430. In this case servo rotor 120 is commanded to move continuously between starting and stopping points 161 and 162 without any coasting, braking or stops. Thus, commands are issued to carry out an acceleration event 241 to drive motor 328 to drive servo rotor 120 to directly to stopping point 162 using a high or max current to motor 328. Following each of steps 420, 426, and 430, sweep time 213 and digital pulse width 201 are saved for use in the next pulse in save data step 436. Then, in reversal step 438, the direction of the next pulse is set to the opposite direction of the current pulse. Then, in waiting step 440, the system delays until the next pulse is initiated, leading back to step 402. Thus, the system uses an algorithmic feedback loop to control the speed and timings of the servo valve.

The invention claimed is:

1. A servo pulser for a mud pulse telemetry MWD system, comprising:

a servo rotor; and a valve seat; and a housing around the rotor, the housing forming at least one arcuate sweep zone rotationally fixed relative to the valve seat; and the servo rotor comprising laterally-extending arms; and at least one digit extending longitudinally from one of said laterally-extending arms in a direction away from the seat and into one of said at least one sweep zone.

2. The servo pulser of claim 1, the housing comprising at least one stop on the interior of said housing;

said stop extending partially radially inward of said valve seat; and the at least one sweep zone comprising at least one clockwise stopping point and at least one counterclockwise stopping point.

3. The servo pulser of claim 2,
the housing comprising two stops; and
one of the stops forming the at least one clockwise stopping point and other of the stops forming the at least one counter-clockwise stopping point.

4. The servo pulser of claim 3,
the housing further comprising a second arcuate sweep zone rotationally fixed relative to the valve seat; and
each of the stops forming a clockwise stopping point and a counter-clockwise stopping point, one of said counter-clockwise stopping points being the clockwise stopping point comprised by the at least one sweep zone.

5. The servo pulser of claim 2,
the servo rotor having a permitted sweep arc defined by mechanical interaction between at least one stop and the at least one digit.

6. The servo pulser of claim 1,
the housing forming two arcuate sweep zones rotationally fixed relative to the valve seat; and
the servo rotor comprising two of said at least one digits,
each of said digits extending into one each of the two sweep zones.

7. The servo pulser of claim 6,
the housing comprising two stops; and
each of the stops forming a clockwise stopping point and a counter-clockwise stopping point.

8. The servo pulser of claim 1,
the servo rotor comprising four laterally-extending arms;
each of said arms comprising a servo tip extending longitudinally toward the seat; and
two digits extending longitudinally from one of said laterally-extending arms in a direction away from the seat.

9. The servo pulser of claim 1,
the servo rotor having a permitted sweep arc defined by mechanical interaction between the housing and the at least one digit.

10. The servo pulser of claim 9,
the sweep arc being at or around 90 degrees.

11. The servo pulser of claim 1,
the valve seat comprising
servo holes; and
travel zones between the servo holes, the travel zones not permitting fluid flow therethrough; and
the travel zones extending about 20-25 degrees.

12. The servo pulser of claim 1,
the valve seat comprising an even number of servo holes; and
the servo rotor comprising
the same even number of laterally-extending arms; and
one-half of that even number of digits, the digits extending longitudinally from one of said laterally-extending arms in a direction away from the seat.

13. A method of controlling a servo pulser for a mud pulse telemetry MWD system, comprising:
rotating a servo rotor;
the servo rotor comprising
laterally-extending arms; and
at least one digit extending longitudinally from one of said laterally-extending arms in a direction away from a valve seat and into at least one arcuate sweep zone; and
the at least one sweep zone formed by a housing around the rotor and rotationally fixed relative to the valve seat.

14. The method of claim 13,
the at least one sweep zone comprising at least one clockwise stopping point and at least one counter-clockwise stopping point; and
the mechanically interacting step occurring at the stopping points at stops extending partially radially inward of said valve seat.

15. The method of claim 13,
the rotating step comprising rotating the servo rotor within a permitted sweep arc defined by mechanically interacting the at least one digit and the housing.

16. The method of claim 13, further comprising
defining a sweep arc of the rotating step by mechanically interacting the at least one digit and the housing.

17. The servo pulser of claim 16,
the sweep arc being at or around 90 degrees.

18. The method of claim 13,
the rotating step comprising rotating the servo rotor between stopping points and through travel zones between servo holes on the servo seat;
the travel zones not permitting fluid flow therethrough; and
the travel zones are about 20-25 degrees in extent.

19. The method of claim 13,
the rotating step comprising creating a full pulse during a single sweep of the servo rotor in a given direction.

20. The method of claim 19,
the single sweep of the servo rotor beginning and ending with the mechanical interaction between the at least one digit and the housing.

21. The method of claim 19,
the rotating step further comprising reversing the direction of the rotation of the servo rotor; and
then creating another full pulse during another single sweep of the servo rotor.

22. The method of claim 13,
the rotating step comprising
the servo rotor starting such that servo tips on said laterally-extending arms fully close servo holes on said servo seat; and
then continuing rotating the servo rotor continuously in one direction first to rotate the servo tips to fully open the servo holes, and then to rotate the servo tips to close the servo holes.

23. The method of claim 22,
the rotating step comprising rotating the servo rotor between stopping points and through travel zones between servo holes on the servo seat;
the travel zones not permitting fluid flow therethrough; and
the travel zones are about 20-25 degrees in extent.

24. The method of claim 22,
the continuing rotating step further comprising braking the rotation of the servo rotor while the servo holes are fully open.

25. The method of claim 13,
the rotating step comprising
the servo rotor starting such that servo tips on said laterally-extending arms fully close servo holes on said servo seat;
then rotating the servo rotor in one direction to rotate the servo tips to fully open the servo holes;
then stopping the servo rotor such that the servo tips rest in travel zones between the servo holes; and
then rotating the servo rotor in the same direction to rotate the servo tips to close the servo holes.

26. The method of claim 13, further comprising
executing a feedback loop between pulses to determine the desired velocity profile for driving the servo rotor.

27. The method of claim 26,
the feedback loop comprising comparing a last-pulse sweep time to a last-pulse digital pulse width.

28. The method of claim 27,
the feedback loop further comprising commanding the servo rotor to move continuously between a starting point and a stopping point.

29. The method of claim 27,
the feedback loop further comprising
commanding the servo rotor to move from a starting point to an intermediate stop in a travel zone;
then checking if enough time has elapsed for a desired pulse width;
then commanding the servo rotor to move from the intermediate stop to a stopping point.

30. The method of claim 26, further comprising
saving the current sweep time and current digital pulse width.

31. A method of controlling a servo pulser for a mud pulse telemetry MWD system, comprising:
executing a feedback loop between pulses to determine the desired velocity profile for driving rotation of a servo rotor in a direction of a current sweep and preparing for driving rotation of the servo rotor in a direction of a current sweep;
the servo rotor comprising laterally-extending arms, and at least one digit, said digit extending longitudinally from one of said laterally-extending arms in a direction away from a valve seat of the servo pulser;
the feedback loop comprising for a current pulse:
comparing a last-pulse sweep time to a last-pulse digital pulse width;
deciding for the current pulse, based upon the results of the comparing step, between issuing a close fast command to the servo rotor and a coast mode check;
saving a current sweep time and a current digital pulse width for use as the last-pulse sweep time and the last-pulse digital pulse width for the next pulse; and
setting the direction of the next pulse for the opposite direction of the current sweep of the current pulse.

32. The method of claim 31, further comprising
between the comparing and saving steps, commanding the servo rotor to move continuously between a starting point and a stopping point.

33. The method of claim 31,
between the comparing and saving steps, commanding the servo rotor to move from a starting point to an intermediate stop in a travel zone;
then checking if enough time has elapsed for a desired pulse width;
then commanding the servo rotor to move from the intermediate stop to a stopping point.

34. The method of claim 33,
carrying out the checking step again, before commanding the servo rotor to move from the intermediate stop to a stopping point.

35. The method of claim 33,
the step of commanding the servo rotor to move from the intermediate stop to a stopping point comprising a deceleration event before reaching the stopping point.

36. A method of pulsing using a servo pulser for a mud pulse telemetry MWD system, comprising:
creating a first full pulse by carrying out a first sweep of a servo rotor in a given direction;
reversing the direction of the rotation of the servo rotor; and
creating a second full pulse by carrying out a second sweep of the servo rotor.

37. The method of claim 36,
the servo rotor rotation limited by a permitted sweep arc, the sweep arc defined by mechanical interactions.

38. The method of claim 37,
defining the sweep arc by mechanically interacting at least one digit extending longitudinally away from a servo seat and a housing.

39. The method of claim 36,
the sweep arc being at or around 90 degrees.

40. The method of claim 39,
the first sweep of a servo rotor step comprising rotating the servo rotor through travel zones between servo holes on a servo seat;
the travel zones not permitting fluid flow therethrough; and
the travel zones are about 20-25 degrees in extent.

41. The method of claim 36, further comprising
executing a feedback loop between the first pulse and the second pulse to determine the desired velocity profile for driving the servo rotor.

42. The method of claim 41,
the feedback loop comprising comparing a last-pulse sweep time to a last-pulse digital pulse width.

43. The method of claim 36,
the carrying out a first sweep step comprising
starting the servo rotor in a first orientation, the first orientation having servo tips fully closing servo holes on a servo seat; and
rotating the servo rotor in the given direction;
the rotating step in the given direction step comprising rotating the servo tips to fully open the servo holes; and
then rotating the servo tips to close the servo holes; and
finishing the servo rotor in a second orientation, the second orientation having servo tips fully closing servo holes on a servo seat.

44. The method of claim 43,
the servo tips comprising a first servo tip;
the servo holes comprising a first servo hole and a second servo hole;
the first servo tip closing the first servo hole in the first orientation and a second servo hole in the second orientation.

45. A servo pulser for a mud pulse telemetry MWD system, comprising:
a valve seat;
the valve seat comprising an even number of servo holes; and
a servo rotor, having an axis of rotation, comprising:
the same even number of rotor arms, extending radially from said axis of rotation and each having a seat side and an opposing stop side;
the same even number of servo tips, one each extending longitudinally from the seat side of one of the rotor arms; and
one-half of that even number of digits, each digit extending longitudinally from the stop side of one of the rotor arms.

46. The servo pulser of claim 45, further comprising:

a housing around the rotor;

the housing comprising at least one stop on the interior of said housing;

said stop extending partially radially inward of said valve seat.

47. The servo pulser of claim 46, further comprising:

the housing comprising at least two stops on the interior of said housing;

said stops extending partially radially inward of said valve seat; and the servo rotor having a permitted sweep arc defined by mechanical interaction between the at least two stops and the digits.

48. The servo pulser of claim 47, the sweep arc being at or around 90 degrees.

* * * * *